US007629529B2

(12) United States Patent
Makino

(10) Patent No.: US 7,629,529 B2
(45) Date of Patent: Dec. 8, 2009

(54) MUSIC-PIECE RETRIEVAL AND PLAYBACK APPARATUS, AND RELATED METHOD

(75) Inventor: Masaaki Makino, Kanagawa-ken (JP)

(73) Assignee: Victor Company of Japan, Ltd., Yokohama (JP)

( * ) Notice: Subject to any disclaimer, the term of this patent is extended or adjusted under 35 U.S.C. 154(b) by 393 days.

(21) Appl. No.: 11/603,204

(22) Filed: Nov. 22, 2006

(65) Prior Publication Data

US 2007/0119288 A1 May 31, 2007

(30) Foreign Application Priority Data

Nov. 29, 2005 (JP) ..... 2005-343840

(51) Int. Cl.
*G10H 1/00* (2006.01)
*G10H 1/18* (2006.01)
*G10H 7/00* (2006.01)

(52) U.S. Cl. ..... 84/615

(58) Field of Classification Search ..... 4/602, 4/615

See application file for complete search history.

(56) References Cited

U.S. PATENT DOCUMENTS 7,199,300 B2 * 4/2007 Kodama et al. ..... 84/601
7,227,071 B2 * 6/2007 Tagawa et al. ..... 84/601
7,231,389 B2 * 6/2007 Yamane et al. ..... 707/5
7,268,288 B2 * 9/2007 Yamane et al. ..... 84/615
2004/0255761 A1 * 12/2004 Yamane et al. ..... 84/615
2004/0260539 A1 * 12/2004 Tagawa et al. ..... 704/201
2004/0267736 A1 * 12/2004 Yamane et al. ..... 707/3
2005/0010599 A1 1/2005 Kake et al.
2005/0241463 A1 * 11/2005 Urata ..... 84/609
2007/0106406 A1 * 5/2007 Makino et al. ..... 700/94

FOREIGN PATENT DOCUMENTS

JP 06-290574 10/1994
JP 09-034909 2/1997
JP 2002-278547 9/2002
JP 2005-010854 1/2005

* cited by examiner

*Primary Examiner*—Jeffrey Donels
(74) *Attorney, Agent, or Firm*—Louis Woo

(57) ABSTRACT

Impression words express impressions about music pieces and are separated into groups called impression axes. Impression words in each of the impression axes have meanings mutually related with each other. There is a correspondence among the impression words, the impression axes, and the music pieces. One is designated among the impression axes. One is designated among the impression words. A music piece corresponding to the designated impression axis and the designated impression word is played back. Commands are generated which constitute questionnaire choice information about the played-back music piece. A user is enabled to choose one from the generated commands. An impression axis and an impression word corresponding to the command chosen by the user are obtained. A music piece corresponding to the obtained impression axis and the obtained impression word is played back.

11 Claims, 21 Drawing Sheets

FIG. 3

| IMPRESSION WORD RANK / IMPRESSION AXIS | 1 | 2 | 3 | |
|---|---|---|---|---|
| POWERFULNESS | HEAVY | POWERFUL | SLIGHTLY POWERFUL | ··· |
| GENTLENESS | CALM | GENTLE | MILD | ··· |
| UPBEAT | LILTING | JOYOUS | RHYTHMICAL | ··· |
| ⋮ | ⋮ | ⋮ | ⋮ | |

FIG. 4

| CONTENT ID | IMPRESSION AXIS | IMPRESSION WORD |
|---|---|---|
| ID1 | GENTLENESS | GENTLE |
| ID2 | POWERFULNESS UPBEAT | POWERFUL RHYTHMICAL |
| ⋮ | ⋮ | ⋮ |

| CONTENT ID | PREFERENCE DEGREE |
|---|---|
| ID1 | 0.6 |
| ID2 | 2.2 |
| ⋮ | ⋮ |

FIG. 7

| | |
|---|---|
| MUSIC PIECE IN PLAYBACK | IDn |
| CURRENT IMPRESSION AXIS | POWERFULNESS |
| CURRENT IMPRESSION WORD | SLIGHTLY POWERFUL |

| | |
|---|---|
| CONTENT IDs OF MUSIC PIECES WHICH HAVE BEEN PLAYED BACK | ID1, ID2, ··· |
| IMPRESSION AXES SELECTED IN THE PAST | GENTLENESS, UPBEAT, ··· |

FIG. 8

① SOMEHOW NOT MATCH MY FEELING
② DESIRE MORE POWERFUL MUSIC PIECE
➡ ③ DESIRE LESS POWERFUL MUSIC PIECE
④ HATE THIS MUSIC PIECE
⑤ LIKE THIS MUSIC PIECE

⑨ END

FIG. 9
| COMMAND MESSAGE / IMPRESSION AXIS | IMPRESSION-WORD RANK-UP COMMAND MESSAGE | IMPRESSION-WORD RANK-DOWN COMMAND MESSAGE |
|---|---|---|
| POWERFULNESS | DESIRE MORE POWERFUL MUSIC PIECE | DESIRE LESS POWERFUL MUSIC PIECE |
| GENTLENESS | DESIRE GENTLER MUSIC PIECE | DESIRE LESS GENTLE MUSIC PIECE |
| UPBEAT | DESIRE MORE UPBEAT MUSIC PIECE | DESIRE LESS UPBEAT MUSIC PIECE |
| ⋮ | ⋮ | ⋮ |
FIG. 10
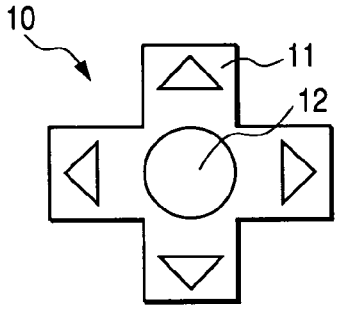
FIG. 11
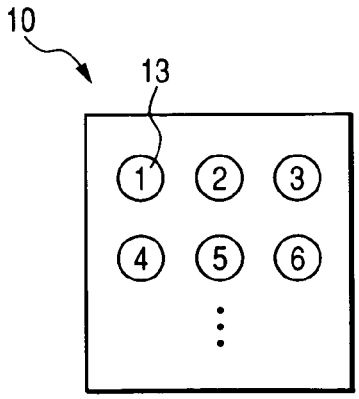

| CONTENT ID | TITLE | ARTIST | GENRE | YEAR | ... |
|---|---|---|---|---|---|
| ID1 | Spiral | Seven Centi Nails | Industrial | 1996 | ... |
| ID2 | Piano | Joe | Soft Rock | 1974 | ... |
| ... | ... | ... | ... | ... | |

| IMPRESSION WORD | EVALUATION VALUE |
|---|---|
| HEAVY | 10 |
| POWERFUL | 10 |
| SLIGHTLY POWERFUL | 27.1 |
| GENTLE | 34.39 |
| MILD | 10 |
| ⋮ | ⋮ |

| PREVIOUSLY IN STAY STATE | CURRENTLY IN STAY STATE | EVALUATION VALUE |
|---|---|---|
| POWERFULNESS AXIS | UPBEAT AXIS | 40 |
| POWERFULNESS AXIS | GENTLENESS AXIS | 10 |
| ⋮ | ⋮ | ⋮ |
| UPBEAT AXIS | POWERFULNESS AXIS | 30 |
| ⋮ | ⋮ | ⋮ |

FIG. 25

| | IMPRESSION WORD | EVALUATION VALUE | PROBABILITY |
|---|---|---|---|
| POWERFULNESS AXIS | HEAVY | 10 | 0.1667 |
| | POWERFUL | 20 | 0.3333 |
| | SLIGHTLY POWERFUL | 30 | 0.5 |

FIG. 26

| POWERFULNESS AXIS PREVIOUSLY IN STAY STATE | | |
|---|---|---|
| CANDIDATE | PATH EVALUATION VALUE | PROBABILITY |
| GENTLENESS AXIS | 20 | 0.3333 |
| UPBEAT AXIS | 40 | 0.6667 |

FIG. 27

| TIME RANGE | IMPRESSION WORD | EVALUATION VALUE |
|---|---|---|
| MORNING | HEAVY | 10 |
| MORNING | POWERFUL | 10 |
| MORNING | SLIGHTLY POWERFUL | 27.1 |
| ⋮ | ⋮ | ⋮ |
| NOON | HEAVY | 41 |
| ⋮ | ⋮ | ⋮ |
| NIGHT | HEAVY | 10 |
| ⋮ | ⋮ | ⋮ |

FIG. 31

| CONTENT ID | FEATURE QUANTITY 1 | FEATURE QUANTITY 2 | ... | FEATURE QUANTITY N |
|---|---|---|---|---|
| ID1 | 0.012003 | 0.129869 | ... | 0.220436 |
| ID2 | 0.03178 | 0.117536 | ... | 0.174924 |
| ⋮ | ⋮ | ⋮ | ... | ⋮ |

MUSIC-PIECE RETRIEVAL AND PLAYBACK APPARATUS, AND RELATED METHOD

BACKGROUND OF THE INVENTION

1. Field of the Invention

This invention relates to a method and an apparatus for retrieving a desired content from music contents in a recording medium, and then playing back the retrieved content.

2. Description of the Related Art

Japanese patent application publication number 09-034909/1997 discloses an information retrieval apparatus including a database which stores files of multimedia data containing sound information. Each file has an added factor vector representing file's position in a factor coordinate space. A user inputs information about a desired file (desired data). The inputted information represents desired-file's position in an adjective coordinate space defined by pairs of adjectives and their antonyms expressing human sensitivities. The inputted information is converted, being mapped onto the factor coordinate space so that the desired-file's position will be in the factor coordinate space. The distances between the database-file's positions and the desired-file's position in the factor coordinate space are computed. Among the database files, ones are selected which correspond to the computed distances smaller than a prescribed value. The selected database files are searched for a target matching the desired file.

In the apparatus of Japanese application 09-034909/1997, the user is required to input parameter values for the respective pairs of adjectives and their antonyms as information about a desired file. Therefore, the user is forced to take a long time in this regard. It tends to be difficult for the user to input parameter values without referring to references.

Japanese patent application publication number 2005-010854 corresponding to U.S. patent application publication number US 2005/0010599 A1 discloses an information presenting system in which files of music pieces are represented in symbols such as stars, and are clustered based on their attributes so as to be allocated in an information space defined by the attributes. Regarding one of the attributes, an impression, such as "refreshing", on the music piece corresponding to a file is represented and given in the form of emotion. The initial search for a desired file is carried out by roughly cutting out a marked-out space from the information space in response to user's operation. When the area containing candidate files is narrowed down, the candidate files are linearly developed so as to support user's selection.

In the system of Japanese application publication number 2005-010854, a display can indicate the information space as a three-dimensional picture. To properly indicate a three-dimensional picture, the display is required to be large in size. Among input devices of various types, only strictly limited ones can be used as an operation unit for accepting user's operation.

Japanese patent application publication number 2002-278547 discloses a system composed of a music-piece registering section, a music-piece database, and a music-piece retrieving section. The music-piece registering section registers audio signals representing respective music pieces and ancillary information pieces relating to the respective music pieces in the music-piece database. Each audio signal representing a music piece and an ancillary information piece relating thereto are in a combination within the music-piece database. Each ancillary information piece has an ID, a bibliographic information piece, acoustic feature values (acoustic feature quantities), and impression values about a corresponding music piece. The bibliographic information piece represents the title of the music piece and the name of a singer or a singer group vocalizing in the music piece.

The music-piece registering section in the system of Japanese application 2002-278547 analyzes each audio signal to detect the values (the quantities) of acoustic features of the audio signal. The detected acoustic feature values are registered in the music-piece database. The music-piece registering section converts the detected acoustic feature values into values of a subjective impression about a music piece represented by the audio signal. The impression values are registered in the music-piece database.

The music-piece retrieving section in the system of Japanese application 2002-278547 responds to user's request for retrieving a desired music piece. The music-piece retrieving section computes impression values of the desired music piece from subjective-impression-related portions of the user's request. Bibliographic-information-related portions are extracted from the user's request. The computed impression values and the extracted bibliographic-information-related portions of the user's request are combined to form a retrieval key. The music-piece retrieving section searches the music-piece database in response to the retrieval key for ancillary information pieces similar to the retrieval key. Music pieces corresponding to the found ancillary information pieces (the search-result ancillary information pieces) are candidate ones. The music-piece retrieving section selects one from the candidate music pieces according to user's selection or a predetermined selection rule. The search for ancillary information pieces similar to the retrieval key has the following steps. Matching is implemented between the extracted bibliographic-information-related portions of the user's request and the bibliographic information pieces in the music-piece database. Similarity between the computed impression values and the impression values in the music-piece database are calculated. From the ancillary information pieces in the music-piece database, ones are selected on the basis of the matching result and the calculated similarities.

Japanese patent application publication number 6-290574/1994 discloses a music-piece retrieval apparatus in which a primary index of each music piece is a bibliographic item about the music piece such as a title thereof. Acoustic features such as a rhythm-related feature and a chord-related feature are derived from audio data representing each music piece. The derived acoustic features are labeled a secondary index of the music piece. A tertiary index of each music piece is generated on the basis of the secondary index thereof. The tertiary index represents subjective and emotional features of the music piece. There are storages which store primary, secondary, and tertiary indexes of many music pieces. To implement retrieval, a user inputs conditions of a desired music piece which are designed to correspond to primary, secondary, and tertiary indexes of the desired music piece. The inputted conditions are compared with the stored primary, secondary, and tertiary indexes of the music pieces. The comparison is to find, among the stored primary, secondary, and tertiary indexes of the music pieces, a set of primary, secondary, and tertiary indexes of at least one music piece which matches the inputted conditions. The music piece corresponding to the found set of primary, secondary, and tertiary indexes is selected as a retrieval result regarding the desired music piece.

In the music-piece retrieval apparatus of Japanese application 6-290574/1994, the derivatives of the acoustic powers of audio data representing each music piece are computed for each prescribed time interval (each frame). The autocorrelation of the power derivatives is calculated. The calculated autocorrelation varies as a function of a frequency parameter or a period parameter. A value of the frequency parameter or the period parameter is decided at which the calculated autocorrelation is maximized. One of the derived acoustic features is generated on the basis of the decided value of the frequency parameter or the period parameter.

SUMMARY OF THE INVENTION

It is a first object of this invention to provide a music-piece retrieval and playback apparatus which does not require a user to perform complicated operation.

It is a second object of this invention to provide a method of music-piece retrieval and playback which does not require a user to perform complicated operation.

A first aspect of this invention provides a music-piece retrieval and playback apparatus comprising a first storage device storing music pieces having identifiers respectively; a second storage device storing impression words expressing impressions about music pieces, the stored impression words being separated into groups called impression axes, wherein impression words in each of the impression axes have meanings mutually related with each other and are assigned prescribed ranks; a third storage device storing the impression words and the identifiers of the music pieces in a manner such that an impression word among the stored impression words is made to correspond to each of the music pieces, and is related with an identifier of each corresponding music piece; first means for designating an impression axis and an impression word; second means for obtaining an identifier corresponding to the impression axis and the impression word designated by the first means from the third storage device; third means for reading out a music piece having an identifier equal to the identifier obtained by the second means from the first storage device; fourth means for generating commands which are designed for changing the impression word designated by the first means, and which constitute questionnaire choice information about the music piece read out by the third means in response to the impression axis and the impression word designated by the first means; fifth means for enabling a user to choose one from the commands generated by the fourth means; sixth means for obtaining an impression axis and an impression word corresponding to the command chosen by the user from the second storage device; and seventh means for updating the impression axis and the impression word designated by the first means to the impression axis and the impression word obtained by the sixth means.

A second aspect of this invention is based on the first aspect thereof, and provides a music-piece retrieval and playback apparatus wherein the commands generated by the fourth means comprise a command for replacing the designated impression word with an impression word having a rank higher or lower by 1 than the rank of the designated impression word in the designated impression axis.

A third aspect of this invention is based on the first aspect thereof, and provides a music-piece retrieval and playback apparatus wherein the commands generated by the fourth means comprise a command for replacing the designated impression axis with another impression axis.

A fourth aspect of this invention provides a music-piece retrieval and playback apparatus comprising a first storage device storing music pieces having identifiers respectively; first means for reading out a music piece from the first storage device; a second storage device storing bibliographic information segments about the respective music pieces stored in the first storage device and the identifiers of the music pieces, and relating the stored bibliographic information pieces with the identifiers of the music pieces respectively; second means for playing back the music piece read out by the first means; third means for generating commands constituting questionnaire choice information concerning the bibliographic information segments; fourth means for enabling the user to choose one from the commands generated by the third means; fifth means for obtaining a bibliographic information segment related with the identifier of the music piece played back by the second means from the second storage device; sixth means for generating a playback condition from the bibliographic information segment obtained by the fifth means and the command chosen by the user through the fourth means; seventh means for obtaining an identifier corresponding to the playback condition generated by the sixth means from the second storage device; eighth means for reading out a music piece having an identifier equal to the identifier obtained by the seventh means from the first storage device; and ninth means for playing back the music piece read out by the eighth means.

A fifth aspect of this invention provides a music-piece retrieval and playback apparatus comprising a first storage device storing music pieces having identifiers respectively; a second storage device storing acoustic feature quantity information segments about the respective music pieces stored in the first storage device and the identifiers of the music pieces, and relating the stored acoustic feature quantity information segments with the identifiers of the music pieces respectively; first means for generating a command to play back a prescribed number of music pieces similar to a music piece currently played back; second means for enabling a user to choose the command generated by the first means; third means for reading out the feature quantity information segments from the second storage device when the command is chosen by the user through the second means; fourth means for calculating Euclidean distances between one of the feature quantity information segments read out by the third means and others of the feature quantity information segments read out by the third means, wherein the one of the feature quantity information segments corresponds to the identifier of the music piece currently played back; fifth means for selecting the prescribed number of smaller ones among the Euclidean distances calculated by the fourth means; sixth means for detecting identifiers corresponding to the Euclidean distances selected by the fifth means; seventh means for reading out the prescribed number of music pieces having identifiers equal to the identifiers detected by the sixth means; and eighth means for playing back the music pieces read out by the seventh means.

A sixth aspect of this invention is based on the first aspect thereof, and provides a music-piece retrieval and playback apparatus further comprising a fourth storage device storing degrees of user's preference for the respective music pieces stored in the first storage device and the identifiers of the music pieces, and relating the stored user's preference degrees with the identifiers of the music pieces respectively; and eighth means provided in the second means for utilizing the fourth storage device and obtaining an identifier from among the identifiers except identifiers corresponding to user's preference degrees less than a prescribed value or obtaining an identifier corresponding to a greatest user's preference degree.

A seventh aspect of this invention is based on the fourth aspect thereof, and provides a music-piece retrieval and playback apparatus further comprising a third storage device storing degrees of user's preference for the respective music pieces stored in the first storage device and the identifiers of the music pieces, and relating the stored user's preference degrees with the identifiers of the music pieces respectively;

and tenth means for utilizing the third storage device and obtaining an identifier from among the identifiers except identifiers corresponding to user's preference degrees less than a prescribed value or obtaining an identifier corresponding to a greatest user's preference degree.

An eighth aspect of this invention is based on the first aspect thereof, and provides a music-piece retrieval and playback apparatus further comprising a fourth storage device storing evaluation values of the impression words; eighth means for increasing one of the evaluation values stored in the fourth storage device in cases where a music piece corresponding to the one of the evaluation values is repetitively played back at least a prescribed number of times or is continuously played back for at least a prescribed time; and ninth means provided in the sixth means for obtaining an impression word in response to the evaluation values stored in the fourth storage device.

A ninth aspect of this invention is based on the first aspect thereof, and provides a music-piece retrieval and playback apparatus further comprising a fourth storage device storing sets each of a first impression axis and a second impression axis, and evaluation values of the sets; a fifth storage device storing each impression axis and each time order in cases where a music piece corresponding to the impression axis is repetitively played back at least a prescribed number of times or is continuously played back for at least a prescribed time; eighth means for increasing an evaluation value stored in the fourth storage device while making two impression axes adjacent in time order in the fifth storage device correspond to the first impression axis and the second impression axis in the fourth storage device; and ninth means provided in the sixth means for obtaining an impression axis in response to the evaluation values stored in the fourth storage device.

A tenth aspect of this invention provides a music-piece retrieval and playback apparatus comprising first means for designating one among impression axes and one among impression words, wherein the impression words express impressions about music pieces and are separated into groups called the impression axes, wherein impression words in each of the impression axes have meanings mutually related with each other, and wherein there is a correspondence among the impression words, the impression axes, and the music pieces; second means for playing back a music piece corresponding to the impression axis and the impression word designated by the first means; third means for generating commands constituting questionnaire choice information about the music piece played back by the second means; fourth means for enabling a user to choose one from the commands generated by the third means; fifth means for obtaining an impression axis and an impression word corresponding to the command chosen by the user; and sixth means for playing back a music piece corresponding to the impression axis and the impression word obtained by the fifth means.

An eleventh aspect of this invention provides a method of music-piece retrieval and playback. The method comprises the steps of designating one among impression axes and one among impression words, wherein the impression words express impressions about music pieces and are separated into groups called the impression axes, wherein impression words in each of the impression axes have meanings mutually related with each other, wherein the music pieces have identifiers respectively, and wherein there is a correspondence among the impression words, the impression axes, and the identifiers; obtaining a first identifier corresponding to the designated impression axis and the designated impression word; playing back a music piece having an identifier equal to the obtained first identifier; generating commands constituting questionnaire choice information about the played back music piece; enabling a user to choose one from the generated commands; obtaining an impression axis and an impression word corresponding to the command chosen by the user; obtaining a second identifier corresponding to the obtained impression axis and the obtained impression word; and playing back a music piece having an identifier equal to the obtained second identifier.

This invention has the following advantages. The user can intuitionally select a desired music piece by performing simple operation. Through interaction, user's impressions about a now-playing music piece are utilized in deciding a music piece to be played back next. This process is iterated. Thus, even in the case where the user does not clearly grasp what music piece is desired to be listened to, the user can find a desired music piece by performing a sequence of the interactions. The user performs decisions and operation for selecting a desired music piece while using a now-playing music piece as a reference. This invention can be implemented in a mobile phone, a portable player, or an on-vehicle device.

BRIEF DESCRIPTION OF THE DRAWINGS

FIG. 3 is a diagram showing an example of the format of information in an impression-setting storing block in FIG. 2.

FIG. 4 is a diagram showing an example of the format of impression data in an impression-data storing block in FIG. 2.

FIG. 7 is a diagram showing an example of the format of non-permanent information in a temporarily storing block in FIG. 2.

FIG. 8 is a diagram showing an example of a picture indicated by a display in FIGS. 1 and 2.

FIG. 9 is a diagram showing an example of the format of data in a command storing block in FIG. 2.

FIG. 10 is a plan view of a first example of a portion of an input device in FIGS. 1 and 2.

FIG. 11 is a plan view of a second example of the portion of the input device in FIGS. 1 and 2.

FIG. 25 is a diagram showing an example of impression words, evaluation values, and probabilities.

FIG. 26 is a diagram showing an example of a selected impression axis, candidate impression axis to be selected next, evaluation values, and probabilities.

FIG. 27 is a diagram showing an example of time ranges, impression words, and evaluation values.

FIG. 31 is a diagram showing an example of the format of information in an acoustic-feature-quantity storing block in FIG. 30.

DETAILED DESCRIPTION OF THE INVENTION

FIRST EMBODIMENT

Figure 1:
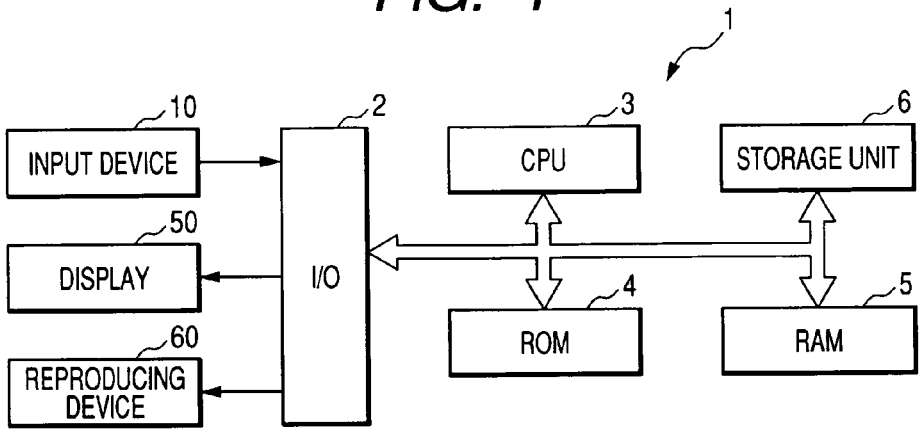
FIG. 1 is a music-piece retrieval and playback apparatus according to a first embodiment of this invention.

FIG. 1 shows a music-piece retrieval and playback apparatus 1 according to a first embodiment of this invention. The music-piece retrieval and playback apparatus 1 includes a computer system having a combination of an input/output port 2, a CPU 3, a ROM 4, a RAM 5, and a storage unit 6. The storage unit 6 includes a large-capacity memory or a combination of a hard disk and a drive therefor. The music-piece retrieval and playback apparatus 1 further includes an input device 10, a display 50, and a reproducing device 60 which are connected with the input/output port 2. The music-piece retrieval and playback apparatus 1 operates in accordance with a control program (a computer program) stored in the ROM 4, the RAM 5, or the storage unit 6.

The input device 10 can be actuated by a user. The input device 10 includes, for example, a mouse, a keyboard, a remote control device, a cross key, or a click wheel. The display 50 includes, for example, a liquid crystal display. The reproducing device 60 can be used to play back a retrieval-result music piece.

Figure 2:
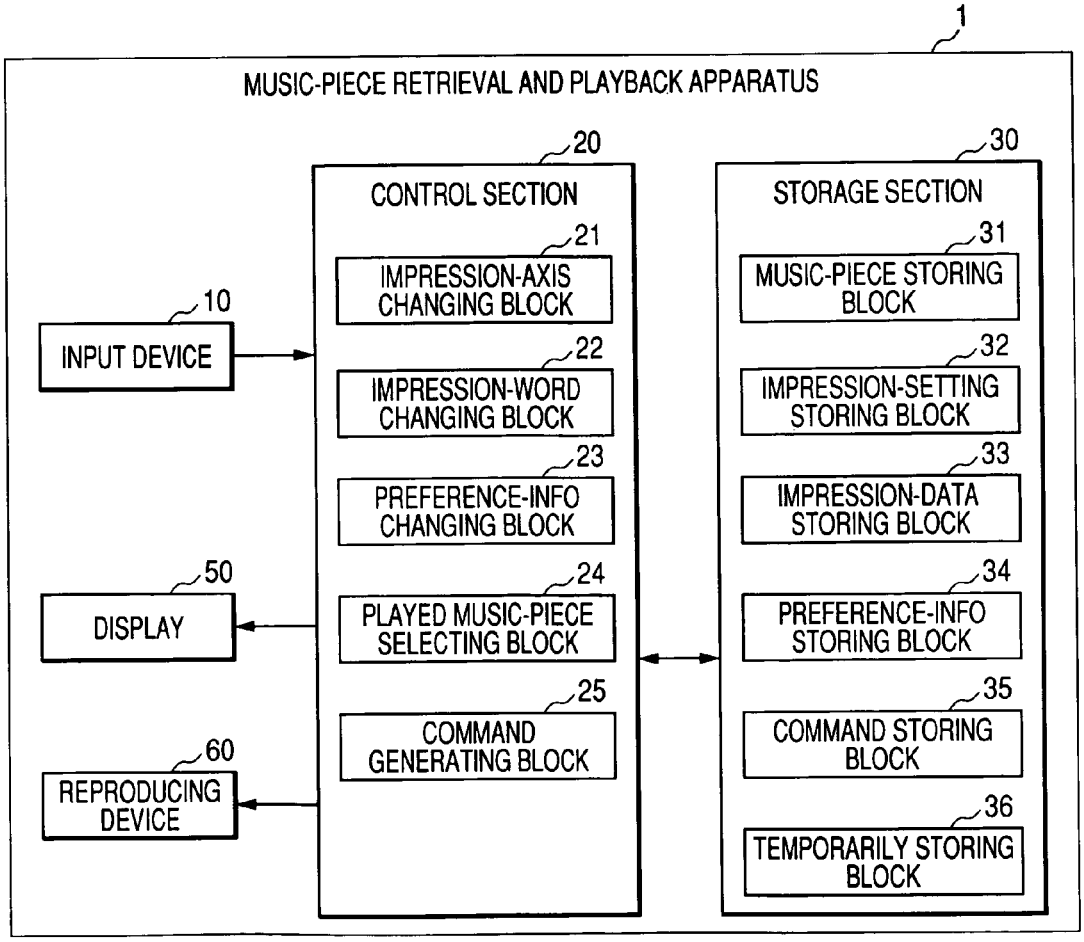
FIG. 2 is an operation diagram of the apparatus in FIG. 1.

FIG. 2 basically shows the operation of the music-piece retrieval and playback apparatus 1. As shown in FIG. 2, a major portion of the music-piece retrieval and playback apparatus 1 is divided into a control section 20 and a storage section 30. The control section 20 is formed mainly by the CPU 3. The storage section 30 is formed mainly by the storage unit 6, a combination of the RAM 5 and the storage unit 6, or a combination of the ROM 4, the RAM 5, and the storage unit 6.

The control section 20 implements an impression-axis changing block 21, an impression-word changing block 22, a preference-information changing block 23, a playback-object music-piece selecting block 24, and a command generating block 25.

The storage section 30 implements a music-piece storing block 31, an impression-setting storing block 32, an impression-data storing block 33, a preference-information storing block 34, a command storing block 35, and a temporarily storing block 36.

The impression-axis changing block 21 changes a currently-selected impression axis. There are impression axes expressing atmospheres of music pieces. One impression axis corresponds to one or more impression words. Specifically, one or more impression words are in one impression axis. In more detail, one or more impression words are an element or elements of one impression axis. Information about the settings of the impression axes is stored in the impression-setting storing block 32.

The impression-word changing block 22 changes a currently-selected impression word in a same impression axis. Generally, impression words are elements of impression axes, and express atmospheres of the music pieces in more detail. Ranks or precedence orders are assigned to impression words, respectively. Each rank (each precedence order) of an impression word denotes the degree of the music-piece atmosphere expressed by the impression word. Information about the settings of impression words is stored in the impression-setting storing block 32.

The preference-information changing block 23 increases or decreases the degree of user's preference for a now-playing music piece, that is, a currently-played music piece, in accordance with an instruction signal (a command choice signal) inputted by a user through the input device 10. Information representing the degrees of user's preference for the respective music pieces is stored in the preference-information storing block 34.

The playback-object music-piece selecting block 24 selects, from the music pieces, one to be played back in the light of a currently-selected impression word and the degrees of user's preference for the respective music pieces.

The command generating block 25 generates commands on the basis of the currently-selected impression word (or the currently-selected impression word and the now-playing music piece) which require the user to input information inclusive of a command choice signal into the apparatus 1 through the input device 10. The command generating block sends the generated commands to the display 50. The display 50 indicates the commands to the user as questionnaire choice information.

The music-piece storing block 31 stores two or more digital audio signals representative of the respective music pieces. It should be noted that the music-piece storing block 31 may store only one digital audio signal representative of a music piece. Different content IDs (identification code words) are assigned to the music pieces, respectively. The content IDs are also called the identifiers. The music-piece storing block 31 stores the content IDs of the respective music pieces. The music pieces represented by the digital audio signals in the music-piece storing block 31 are managed through the use of the content IDs.

The impression-setting storing block 32 stores information representative of the impression axes expressing the atmospheres of the respective music pieces, information representative of the impression words being elements of the impression axes, and information representative of the ranks of the respective impression words. Impression words in each of the impression axes have meanings mutually related with each other.

FIG. 3 shows an example of the format of the information stored in the impression-setting storing block 32. As shown in FIG. 3, the information represents a table having rows, columns, and cells. The cells in the table store impression words, respectively. Examples of the impression words are "heavy", "powerful", "slightly powerful", "calm", "gentle", "mild", "lilting", "joyous", and "rhythmical". The rows in the table are assigned to the impression axes, respectively. Examples of the impression axes are "powerfulness", "gentleness", and "upbeat". The columns in the table are assigned to different ranks, respectively. Each of the impression word is assigned to an impression axis and a rank.

In FIG. 3, the impression words "heavy", "powerful", and "slightly powerful" are elements of the impression axis "powerfulness". The impression words "calm", "gentle", and "mild" are elements of the impression axis "gentleness". The impression words "lilting", "joyous", and "rhythmical" are elements of the impression axis "upbeat". In the impression axis "powerfulness", the impression words "heavy", "powerful", and "slightly powerful" are assigned first, second, and third ranks (ranks of "1", "2", and "3") respectively. In the impression axis "gentleness", the impression words "calm", "gentle", and "mild" are assigned first, second, and third ranks (ranks of "1", "2", and "3") respectively. In the impression axis "upbeat", the impression words "lilting", "joyous", and "rhythmical" are assigned first, second, and third ranks (ranks of "1", "2", and "3") respectively. It should be noted that the number of impression words in one impression axis may vary from axis to axis.

The impression-data storing block 33 stores impression data representing a correspondence or a relation among the music pieces (the content IDs of the music pieces), the impression axes, and the impression words.

FIG. 4 shows an example of the format of the impression data stored in the impression-data storing block 33. As shown in FIG. 4, the impression data indicates the content IDs of the respective music pieces, an impression axis or axes assigned to each of the music pieces (each of the content IDs of the respective music pieces), and an impression word or words assigned to each of the music pieces (each of the content IDs of the respective music pieces).

Preferably, a method of assigning an impression word or words to a music piece includes a step of generating acoustic feature quantities from a digital audio signal representative of the music piece, and a step of generating the impression word or words in response to the generated acoustic feature quantities. Specifically, acoustic feature quantities are calculated from a digital audio signal representative of a music piece in a conventional way, for example, a way disclosed by Japanese patent application publication number 6-290574/1994 or Japanese patent application publication number 2002-278547. Next, a set of learning-purpose music pieces is prepared. Impression words are given to the learning-purpose music pieces. Then, rules for converting calculated acoustic feature quantities into an impression word or words through the use of a known decision tree or Bayes' rule are decided on the basis of a learning procedure using the set of the learning-purpose music pieces and the impression words given thereto. Thereafter, an impression word or words are generated from the calculated acoustic feature quantities according to the decided converting rules.

Figures 5, 6:
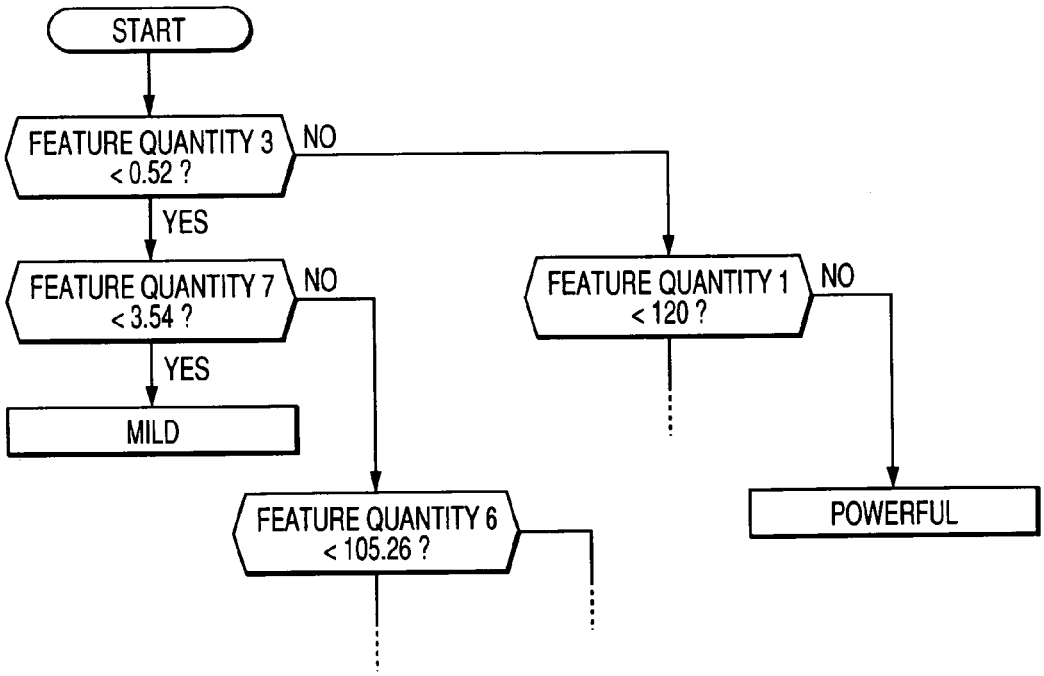
FIG. 5 is a flow diagram of an example of a decision-tree-based algorithm.
FIG. 6 is a diagram showing an example of the format of preference information in a preference-information storing block in FIG. 2.

FIG. 5 shows an example of a decision-tree-based algorithm by which calculated acoustic feature quantities are converted into an impression word. According to the decision-tree-based algorithm in FIG. 5, the calculated acoustic feature quantities are converted into the impression word "powerful" when the calculated feature quantity "3" is equal to or greater than "0.52" and the calculated feature quantity "1" is equal to or greater than "120". The calculated acoustic feature quantities are converted into the impression word "mild" when the calculated feature quantity "3" is smaller than "0.52" and the calculated feature quantity "7" is smaller than "3.54".

The utilization of Bayes' rule in converting calculated acoustic feature quantities into an impression word or words is as follows. The calculated acoustic feature quantities "x" are expressed by an N-order vector (x1, x2, x3, . . . , xN). There are M different prescribed words from which one is selected as a conversion-result impression word, where M denotes a predetermined natural number. Namely, there are M different candidate impression words $C_1, C_2, C_3, \ldots, C_M$. A conversion-result impression word $C_k$ is selected from the candidate impression words $C_1, C_2, C_3, \ldots, C_M$ in response to the calculated acoustic feature quantities "x" according to the following equation.

$$C_k = \underset{i\in\{1,\ldots,M\}}{\operatorname{argmax}} P(C_i \mid x) = \underset{i\in\{1,\ldots,M\}}{\operatorname{argmax}} P(C_i)\cdot P(x \mid C_i)$$

where $P(C_i|x)$ denotes a conditional probability that the calculated acoustic feature quantities "x" will be converted into an impression word $C_i$ (i=1, . . . , M); $P(x|C_i)$ denotes a conditional probability that calculated acoustic feature quantities will be those "x" under the condition of an impression word $C_i$; and $P(C_i)$ denotes a prior probability that a conversion-result word will be an impression word $C_i$.

Data representing the prior probabilities $P(C_i)$ and data representing the conditional probabilities P(x|Ci) for the M candidate feature-quantity impression words are prepared, where $P(C_i)=P(C_i), P(C_2), \ldots, P(C_M)$ and $P(x|Ci)=P(x|C_1), P(x|C_2), \ldots, P(x|C_M)$. These data are accessed in response to the calculated acoustic feature quantities "x", and thereby the prior probabilities $P(C_i)$ and the conditional probabilities P(x|Ci) are obtained. Then, the products $P(C_i)\cdot P(x|C_i)$ of the obtained prior probabilities $P(C_i)$ and the obtained conditional probabilities P(x|Ci) are computed. Subsequently, maximum one among the computed products $P(C_i)\cdot P(x|C_i)$ is detected. Then, among the M candidate impression words, one is detected which corresponds to the detected maximum product. Thereafter, the detected impression word is labeled a conversion-result impression word $C_k$.

The above-mentioned method utilizing the known decision tree or Bayes' rule may be replaced by another method of assigning an impression word or words to a music piece. Alternatively, the assignment of an impression word or words to a music piece may be made by manual steps.

The preference-information storing block 34 stores the information (the preference information) representing the degrees of user's preference for the respective music pieces and the content IDs of the respective music pieces.

FIG. 6 shows an example of the format of the preference information stored in the preference-information storing block 34. As shown in FIG. 6, the preference information represents the degrees of user's preference for the respective music pieces, and the correspondence between the user's preference degrees and the content IDs of the respective music pieces.

The command storing block 35 stores data (rule data) representing rules about the generation of commands by the command generating block 25. The rules include impression-word rank-up command messages and impression-word rank-down command messages in pairs assigned to the respective impression axes. The generated commands are designed to require the user to input information inclusive of a command choice signal into the apparatus 1 through the input device 10.

The temporarily storing block 36 stores non-permanent information including information representing the content ID of a music piece to be played back or the content IDs of music pieces to be played back, information representing the content ID of a now-playing music piece, information representing a currently-selected impression axis, information representing a currently-selected impression word, information representing the content IDs of music pieces played in the past, and information representing impression axes selected in the past.

FIG. 7 shows an example of the format of the non-permanent information stored in the temporarily storing block 36. As shown in FIG. 7, the non-permanent information represents a group of the content ID of a now-playing music piece, a currently-selected impression axis, and a currently-selected impression word. The non-permanent information further represents a group of the content IDs of music pieces played in the past, and impression axes selected in the past.

As previously mentioned, the display 50 can indicate to the user the commands generated by the command generating block 25. The reproducing device 60 includes a music-piece player, loudspeakers, or headphones.

The music-piece retrieval and playback apparatus 1 operates as follows. When the music-piece retrieval and playback apparatus 1 is started, the control section 20 sets an initial impression axis and an initial impression word. According to a first example, the setting of an initial impression axis and an initial impression word is random. According to a second example, an impression axis and an impression word corresponding to a music piece played last during immediately-preceding operation of the apparatus 1 are used as initial ones. The control section 20 loads the temporarily storing block 36 with information representing the initial impression axis and the initial impression word as a currently-selected impression axis and a currently-selected impression word. The control section 20 recognizes the currently-selected impression axis and the currently-selected impression word.

The playback-object music-piece selecting block 24 selects or designates a music piece to be played back. Specifically, the playback-object music-piece selecting block 24 refers to the impression-data storing block 33 in response to the currently-selected impression word, and thereby detects the content IDs of music pieces corresponding to the currently-selected impression word. Subsequently, the playback-object music-piece selecting block 24 refers to the preference-information storing block 34 in response to the detected content IDs, and thereby detects the degrees of user's preference for respective music pieces having the content IDs same as the detected content IDs. Thereafter, the playback-object music-piece selecting block 24 selects the greatest one among the detected user's preference degrees. Then, the playback-object music-piece selecting block 24 labels a music piece corresponding to the greatest user's preference degree as an object to be played back. At the same time, the playback-object music-piece selecting block 24 detects the content ID of the music piece corresponding to the greatest user's preference degree. Subsequently, the playback-object music-piece selecting block 24 loads the temporarily storing block 36 with information representing the content ID of the music piece to be played back and also information representing that the music piece to be played back has already been selected. The music piece to be played back is also called the selected music piece.

After detecting the content IDs of music pieces corresponding to the currently-selected impression word, the playback-object music-piece selecting block 24 may randomly select one among the detected content IDs. In this case, the playback-object music-piece selecting block 24 loads the temporarily storing block 36 with information representing the selected content ID as the content ID of a selected music piece (a music piece to be played back).

The control section 20 transfers a digital audio signal of the selected music piece (the music piece to be played back) from the music-piece storing block 31 to the reproducing device 60. The control section 20 controls the reproducing device 60 to play back the selected music piece.

During the playback of the selected music piece, the command generating block 25 generates commands in the light of the currently-selected impression word and the now-playing music piece. The generated commands are designed for requiring the user to input a command choice signal into the apparatus 1 through the input device 10. Identification (ID) numbers are assigned to the generated commands, respectively. Each of the generated commands has a combination of a corresponding ID number and a message (questionnaire choice information). The command generating block 25 feeds the generated commands to the display 50. The control section 20 controls the display 50 to indicate the commands as questionnaire choice information.

It should be noted that the command generating block 25 may generate commands before the start of the playback of the selected music piece.

Commands designed for requiring the user to input a command choice signal into the apparatus 1 include commands for changing the currently-selected impression axis, commands for changing the currently-selected impression word, and commands for the preference information.

FIG. 8 shows an example of a picture indicated by the display 50 which includes ID numbers and messages (questionnaire choice information) in commands designed for requiring the user to input a command choice signal into the apparatus 1. In FIG. 8, the ID numbers precede the corresponding messages respectively.

With reference to FIG. 8, there are a command having a combination of an ID number of ① and a message of "somehow not match my feeling", a command having a combination of an ID number of ② and a message of "desire more powerful music", a command having a combination of an ID number of ③ and a message of "desire less powerful music piece", a command having a combination of an ID number of ④ and a message of "hate this music piece", a command having a combination of an ID number of ⑤ and a message of "like this music piece", and a command having a combination of an ID number of ⑨ and a message of "end".

As will be explained later, a message of "desire more powerful music piece" and a message of "desire less powerful music piece" in the commands having ID numbers of ② and ③ in FIG. 8 are an impression-word rank-up command message and an impression-word rank-down command message respectively.

The details of the generation of commands by the command generating block 25 are as follows. A combination of an ID number and a message (questionnaire choice information) in each command is independent of the now-playing music piece. Firstly, the command generating block 25 generates a command or commands for changing the currently-selected impression axis. In FIG. 8, the generated command for changing the currently-selected impression axis has a combination of an ID number of ① and a message of "somehow not match my feeling".

Secondly, the command generating block 25 generates commands for the preference information which require the user to increase and decrease the degree of user's preference for the now-playing music piece. In FIG. 8, first one of the generated commands for the preference information has a combination of an ID number of ④ and a message of "hate this music piece". It should be noted that throughout the specification, "hate" is used as a general word meaning "dislike" and "not my favorite" also. The first command requires the user to decrease the degree of user's preference for the now-playing music piece. Second one of the generated commands for the preference information has a combination of an ID number of ⑤ and a message of "like this music piece". The second command requires the user to increase the degree of user's preference for the now-playing music piece.

Thirdly, the command generating block 25 generates commands for changing the currently-selected impression word. The generated commands include an impression-word rank-up command and an impression-word rank-down command for increasing and decreasing the rank of the currently-selected impression word respectively. The impression-word rank-up command and the impression-word rank-down command are utilized for a correction made in the case where user's feelings about the now-playing music piece slightly differ from desired ones.

Specifically, the command generating block 25 accesses the temporarily storing block 36 to obtain the currently-selected impression axis and the currently-selected impression word. Then, the command generating block 25 refers to the command storing block 35 in response to the currently-selected impression axis to obtain an impression-word rank-up command message and an impression-word rank-down command message. Next, the command generating block 25 assigns command ID numbers to the obtained impression-word rank-up command message and the obtained impression-word rank-down command message to complete an impression-word rank-up command and an impression-word rank-down command respectively.

The command generating block 25 accesses the impression-setting storing block 32 in response to the currently-selected impression word to obtain the rank of the currently-selected impression word. The command generating block 25 refers to the impression-setting storing block 32 in response to the currently-selected impression axis to obtain impression words in the currently-selected impression axis. Furthermore, the command generating block 25 accesses the impression-setting storing block 32 in response to the obtained impression words in the currently-selected impression axis to obtain the ranks thereof. The command generating block 25 decides whether or not the rank of the currently-selected impression word is the highest among the ranks of the currently-selected impression word and the other impression words in the currently-selected impression axis. When it is decided that the rank of the currently-selected impression word is the highest, the command generating block 25 does not generate an impression-word rank-up command. Otherwise, the command generating block 25 generates an impression-word rank-up command. In addition, the command generating block 25 decides whether or not the rank of the currently-selected impression word is the lowest among the ranks of the currently-selected impression word and the other impression words in the currently-selected impression axis. When it is decided that the rank of the currently-selected impression word is the lowest, the command generating block 25 does not generate an impression-word rank-down command. Otherwise, the command generating block 25 generates an impression-word rank-down command.

FIG. 9 shows an example of the format of the data stored in the command storing block 35. As shown in FIG. 9, the data stored by the command storing block 35 represents impression-word rank-up command messages and impression-word rank-down command messages in pairs assigned to the respective impression axes. When the currently-selected impression axis is "powerfulness", the command generating block 25 obtains, from the command storing block 35, a message of "desire more powerful music piece" and a message of "desire less powerful music piece" as an impression-word rank-up command message and an impression-word rank-down command message respectively. In FIG. 8, there are a command having a combination of an ID number of ② and a message of "desire more powerful music", and a command having a combination of an ID number of ③ and a message of "desire less powerful music piece".

Furthermore, the command generating block 25 generates a command having a combination of an ID number of ⑨ and a message of "end" (see FIG. 8). This command is referred to as the end command.

The control section 20 controls the display 50 to indicate the commands generated by the command generating block 25. The indication of the commands by the display 50 is of a form such as shown in FIG. 8.

Thereafter, the control section 20 decides whether or not a command choice signal has been inputted by the user through the input device 10.

FIG. 10 shows a first example of a portion of the input device 10. The input device 10 of FIG. 10 includes a cross key composed of a command choice button 11 and a decision button 12 which can be actuated by the user. A cursor with an arrow in FIG. 8 is moved in accordance with operation of the command choice button 11. The user actuates the command choice button 11 to move the cursor to a position where the cursor points to a desired command. Then, the desired command is chosen and a corresponding command choice signal is inputted into the apparatus 1 when the user presses the decision button 12.

FIG. 11 shows a second example of the portion of the input device 10. The input device 10 of FIG. 11 includes an array of numeral keys 13 having different numbers thereon respectively. When the user presses one among the numeral keys 13, a command having an ID number equal to the number on the pressed numeral key 13 is chosen and a corresponding command choice signal is inputted into the apparatus 1. For example, when the user presses the numeral key 13 with a number of "1", a command having a combination of an ID number of ① and a message of "somehow not match my feeling" is chosen (see FIG. 8).

When it is decided that a command choice signal has been inputted by the user through the input device 10, the control section 20 further decides whether or not the chosen command corresponding to the command choice signal is the end command. In the case where the chosen command is the end command, the control section 20 terminates the operation of the music-piece retrieval and playback apparatus 1. The input device 10 may be provided with a specified button such as a power supply button for the end command. In this case, when the user presses the specified button, the end command is selected so that the control section 20 terminates the operation of the music-piece retrieval and playback apparatus 1.

In the case where the chosen command differs from the end command, the control section 20 evaluates the now-playing music piece in accordance with the chosen command. The control section 20 decides to selectively maintain the now-playing music piece or replace it by new one in response to the result of the evaluation. When the now-playing music piece is decided to be replaced by new one, the control section 20 transfers a digital audio signal of the newly-selected music piece (the new music piece to be played back) from the music-piece storing block 31 to the reproducing device 60. The control section 20 controls the reproducing device 60 to play back the newly-selected music piece. On the other hand, when the now-playing music piece is decided to be maintained, the command generating block 25 generates commands anew. The generated commands are indicated by the display 50 so that the user is required to input a command choice signal into the apparatus 1 through the input device 10.

When it is decided that a command choice signal has not been inputted by the user through the input device 10, the control section 20 further decides whether or not the playback of the currently-selected music piece has ended. In the case where the playback of the currently-selected music piece has not ended, the control section 20 decides whether or not a command choice signal has been inputted by the user through the input device 10 again.

On the other hand, in the case where the playback of the currently-selected music piece has ended, the playback-object music-piece selecting block 24 selects, from the music pieces, one to be played back which corresponds to the impression word same as the currently-selected impression word, and which has not been played back yet. Specifically, the playback-object music-piece selecting block 24 retrieves the currently-selected impression axis and the currently-selected impression word from the temporarily storing block 36. Next, the playback-object music-piece selecting block 24 refers to the impression-data storing block 33 in response to the currently-selected impression word, and thereby detects the content IDs of music pieces corresponding to the currently-selected impression word. Subsequently, the playback-object music-piece selecting block 24 refers to the preference-information storing block 34 in response to the detected content IDs, and thereby detects the degrees of user's preference for respective music pieces having the content IDs same as the detected content IDs. Thereafter, the playback-object music-piece selecting block 24 elects, among the detected user's preference degrees, ones equal to or higher than a prescribed value. Next, the playback-object music-piece selecting block 24 selects one from the elected user's preference degrees in the priority order where a higher priority is given to a higher degree. Accordingly, the detected user's preference degrees lower than the prescribed value are not selected. Then, the playback-object music-piece selecting block 24 labels a music piece corresponding to the selected user's preference degree as an object to be played back. At the same time, the playback-object music-piece selecting block 24 detects the content ID of the music piece corresponding to the selected user's preference degree. Subsequently, the playback-object music-piece selecting block 24 loads the temporarily storing block 36 with information representing the content ID of the music piece to be played back and also information representing that the music piece to be played back has already been selected.

After detecting the content IDs of music pieces corresponding to the currently-selected impression word, the playback-object music-piece selecting block 24 may randomly select one among the detected content IDs. In this case, the playback-object music-piece selecting block 24 loads the temporarily storing block 36 with information representing the selected content ID as the content ID of a selected music piece (a music piece to be played back).

In the absence of a music piece corresponding to the currently-selected impression word, the control section 20 accesses the temporarily storing block 36 and clears the information representing the music pieces which have already been selected. At that time, the control section 20 may replace the currently-selected impression word or the currently-selected impression axis by another.

In the case where the playback of the currently-selected music piece has ended, the control section 20 may increase the user's preference degree for the music piece by a prescribed value. Specifically, the control section 20 obtains, from the temporarily storing block 36, the content ID of the music piece which has been played back. The control section 20 accesses the preference-information storing block 34 in response to the obtained content ID to detect the user's preference degree for the music piece which has been played back. The preference-information changing block 23 increases the detected user's preference degree by a prescribed value. The control section 20 updates the information in the preference-information storing block 34 to represent the increased user's preference degree for the music piece which has been played back. The increase in the user's preference degree is based on the conjecture that the user likes the music piece which has been played back.

As previously mentioned, the control section 20 evaluates the now-playing music piece in accordance with the chosen command. The details of the evaluation are indicated hereafter. First, the control section 20 decides whether or not the chosen command is for changing the currently-selected impression axis. In FIG. 8, the command having a combination of an ID number of ① and a message of "somehow not match my feeling" is for changing the currently-selected impression axis.

When the chosen command is not for changing the currently-selected impression axis, the control section 20 further decides whether or not the chosen command is for changing the currently-selected impression word. In FIG. 8, the command having a combination of an ID number of ② and a message of "desire more powerful music", and a command having a combination of an ID number of ③ and a message of "desire less powerful music piece" are for changing the currently-selected impression word.

When the chosen command is not for changing the currently-selected impression word, the control selection 20 further decides whether or not the chosen command is for the preference information. In the case where the chosen command is not for the preference information, the playback-object music-piece selecting block 24 does not change the now-playing music piece and then the control section 20 terminates the evaluation of the now-playing music piece. In FIG. 8, the command having a combination of an ID number of ④ and a message of "hate this music piece", and the command having a combination of an ID number of ⑤ and a message of "like this music piece" are for the preference information.

In the case where the control section 20 decides that the chosen command is for changing the currently-selected impression axis, the impression-axis changing block 21 replaces the currently-selected impression axis by another impression axis. Specifically, the impression-axis changing block 21 retrieves the currently-selected impression axis and the currently-selected impression word from the temporarily storing block 36. Next, the impression-axis changing block 21 randomly selects an impression axis other than the currently-selected impression axis from the impression axes represented by the information in the impression-setting storing block 32. Then, the impression-axis changing block 21 loads the temporarily storing block 36 with information representing the newly-selected impression axis as a currently-selected impression axis. For example, when the currently-selected impression axis is "powerfulness", an impression axis of "gentleness" or "upbeat" is newly selected. As previously mentioned, in FIG. 8, the command having a combination of an ID number of ① and a message of "somehow not match my feeling" is for changing the currently-selected impression axis.

The impression-axis changing block 21 does not select impression axes which have been selected once. The control section 20 loads the temporarily storing block 36 with information representing the impression axis or axes which have been selected. When all the impression axes have been selected, the control section 20 accesses the temporarily storing block 36 and clears the information representing the impression axes which have been selected. As a result, all the impression axes are handled thereafter as ones which have not been selected.

The above-mentioned random selection of an impression axis does not make a burden on the user, and is suited to the user who does not grasp what music piece is desired to be listened to at all. Iteration of the random impression-axis selection allows the user to find a desired music piece, that is, a music piece the user wants to listen to.

After the change of the currently-selected impression axis, the control section 20 selects one from the impression words in the newly-selected impression axis. Specifically, the control section 20 randomly selects one from the impression words. Alternatively, the control section 20 may select an impression word substantially at the center of the newly-selected impression axis from the impression words therein. The random impression-word selection is as follows. First, the control section 20 generates a random number. Second, the control section 20 selects one from the impression words in accordance with the generated random number. For example, an interval between "0" and "1" is divided into portions to which the impression words in the newly-selected impression axis are assigned respectively. A random number in the range between "0" and "1" is generated. Detection is made as which of the portions the generated random number belongs to. The impression word assigned to the detected portion is selected. The control section 20 loads the temporarily storing block 36 with information representing this selected impression word as a currently-selected impression word. In this way, the change of the currently-selected impression word follows the change of the currently-selected impression axis.

In the case where the control section 20 decides that the chosen command is for changing the currently-selected impression word, the impression-word changing block 22 replaces the currently-selected impression word by another impression word in accordance with the chosen command. Specifically, the impression-word changing block 22 retrieves the currently-selected impression axis and the currently-selected impression word from the temporarily storing block 36. Next, the impression-word changing block 22 refers to the impression-setting storing block 32 in response to the currently-selected impression axis and the currently-selected impression word to obtain the rank of the currently-selected impression word. Then, the impression-word changing block 22 replaces the currently-selected impression word by another impression word in the currently-selected impression axis in accordance with the chosen command and the obtained rank.

When the chosen command is an impression-word rank-up command, the impression-word changing block 22 refers to the impression-setting storing block 32 in response to the currently-selected impression axis and the rank of the currently-selected impression word to detect an impression word having a rank higher by 1 than the rank of the currently-selected impression word. When the chosen command is an impression-word rank-down command, the impression-word changing block 22 refers to the impression-setting storing block 32 in response to the currently-selected impression axis and the rank of the currently-selected impression word to detect an impression word having a rank lower by 1 than the rank of the currently-selected impression word. The control section 20 loads the temporarily storing block 36 with information representing the detected impression word as a currently-selected impression word.

Figure 12:
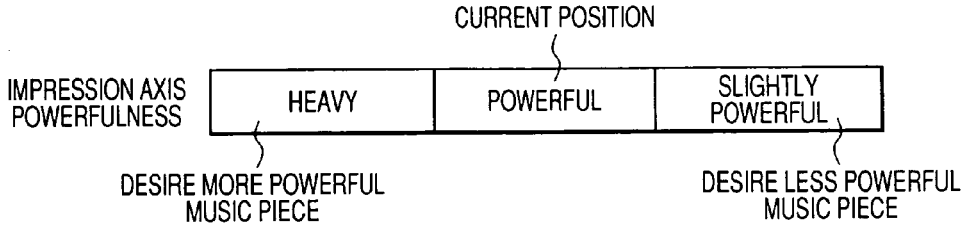
FIG. 12 is a diagram showing impression words in an impression axis "powerfulness", and a relation among an impression-word rank-up command, an impression-word rank-down command, and an impression word selected next.

With reference to FIG. 12, the currently-selected impression axis is "powerfulness", and the currently-selected impression word is "powerful". When the chosen command is an impression-word rank-up command, that is, a command having a combination of an ID number of ② and a message of "desire more powerful music" (see FIG. 8), the impression-word changing block 22 changes the currently-selected impression word from "powerful" to "heavy" having a rank higher by 1 than the rank of "powerful". When the chosen command is an impression-word rank-down command, that is, a command having a combination of an ID number of ③ and a message of "desire less powerful music piece" (see FIG. 8), the impression-word changing block 22 changes the currently-selected impression word from "powerful" to "slightly powerful" having a rank lower by 1 than the rank of "powerful".

In the case where the control section 20 decides that the chosen command is for the preference information, the preference-information changing block 23 increases or decreases the user's preference degree for the now-playing music piece. Then, the preference-information changing block 23 updates the information in the preference-information storing block 34 to represent the increased or decreased user's preference degree for the now-playing music piece. Specifically, the preference-information changing block 23 retrieves the content ID of the now-playing music piece from the temporarily storing block 36. Then, the preference-information changing block 23 refers to the preference-information storing block 34 in response to the retrieved content ID to obtain the user's preference degree for the now-playing music piece. Subsequently, the preference-information changing block 23 increases or decreases the user's preference degree for the now-playing music piece in accordance with the chosen command. Thereafter, the preference-information changing block 23 updates the information in the preference-information storing block 34 to represent the increased or decreased user's preference degree for the now-playing music piece.

When the chosen command has a combination of an ID number of ④ and a message of "hate this music piece" (see FIG. 8), the preference-information changing block 23 decreases the user's preference degree for the now-playing music piece. On the other hand, when the chosen command has a combination of an ID number of ⑤ and a message of "like this music piece", the preference-information changing block 23 increases the user's preference degree for the now-playing music piece.

After the increase or the decrease of the user's preference degree for the now-playing music piece, the control section 20 decides whether or not the user's preference degree for the now-playing music piece has been decreased. When the user's preference degree for the now-playing music piece has not been decreased, the playback-object music-piece selecting block 24 does not change the now-playing music piece and then the control section 20 terminates the evaluation of the now-playing music piece.

After the currently-selected impression word has been changed or when the user's preference degree for the now-playing music piece has been decreased, the playback-object music-piece selecting block 24 changes the now-playing music piece. Especially, when the user's preference degree for the now-playing music piece has been decreased, the playback-object music-piece selecting block 24 selects from the music pieces one corresponding to the impression word same as the currently-selected impression word. The selected music piece replaces the now-playing music piece. After the currently-selected impression word has been changed, the playback-object music-piece selecting block 24 refers to the impression-data storing block 33 in response to the change-result impression word, and thereby detects the content IDs of music pieces corresponding to the change-result impression word. Subsequently, the playback-object music-piece selecting block 24 randomly selects one from the detected content IDs. Then, the playback-object music-piece selecting block 24 labels the music piece having the selected content ID as a new object to be played back. Thereafter, the playback-object music-piece selecting block 24 loads the temporarily storing block 36 with information representing the selected content ID as the content ID of a now-playing music piece.

The selection of a new music piece to be played back may utilize the user's preference degrees for the music pieces. Specifically, the control section 20 detects the content IDs of music pieces corresponding to the currently-selected impression word. Then, the control section 20 refers to the preference-information storing block 34 in response to the detected content IDs, and thereby detects the degrees of user's preference for respective music pieces having the content IDs same as the detected content IDs. Thereafter, the playback-object music-piece selecting block 24 selects one from the detected user's preference degrees in the priority order where a higher priority is given to a higher degree. It is preferable that the detected user's preference degrees lower than a prescribed value are not selected. Then, the playback-object music-piece selecting block 24 labels a music piece corresponding to the selected user's preference degree as a new object to be played back. With reference to FIG. 6, the music piece having a content ID being ID1 is equal to 0.6 in user's preference degree, and the music piece having a content ID being ID2 is equal to 2.2 in user's preference degree. Therefore, the music piece having a content ID being ID2 is higher in selection priority than the music piece having a content ID being ID1.

As previously mentioned, the music-piece retrieval and playback apparatus 1 operates in accordance with a control program (a computer program) stored in the ROM 4, the RAM 5, or the storage unit 6. The digital audio signals representing the respective music pieces, the content IDs of the respective music pieces, the information representing the impression axes, the information representing the impression words, and the information representing the ranks of the respective impression words are stored in the storage unit 6. Furthermore, the impression data representing the correspondence or the relation among the music pieces (the content IDs of the music pieces), the impression axes, and the impression words is stored in the storage unit 6. In addition, the preference information representing the degrees of user's preference for the respective music pieces is stored in the storage unit 6. Furthermore, the rule data representing the rules about the generation of commands is stored in the ROM 4, the RAM 5, or the storage unit 6. As previously mentioned, the rules include impression-word rank-up command messages and impression-word rank-down command messages in pairs assigned to the respective impression axes.

Figure 13:
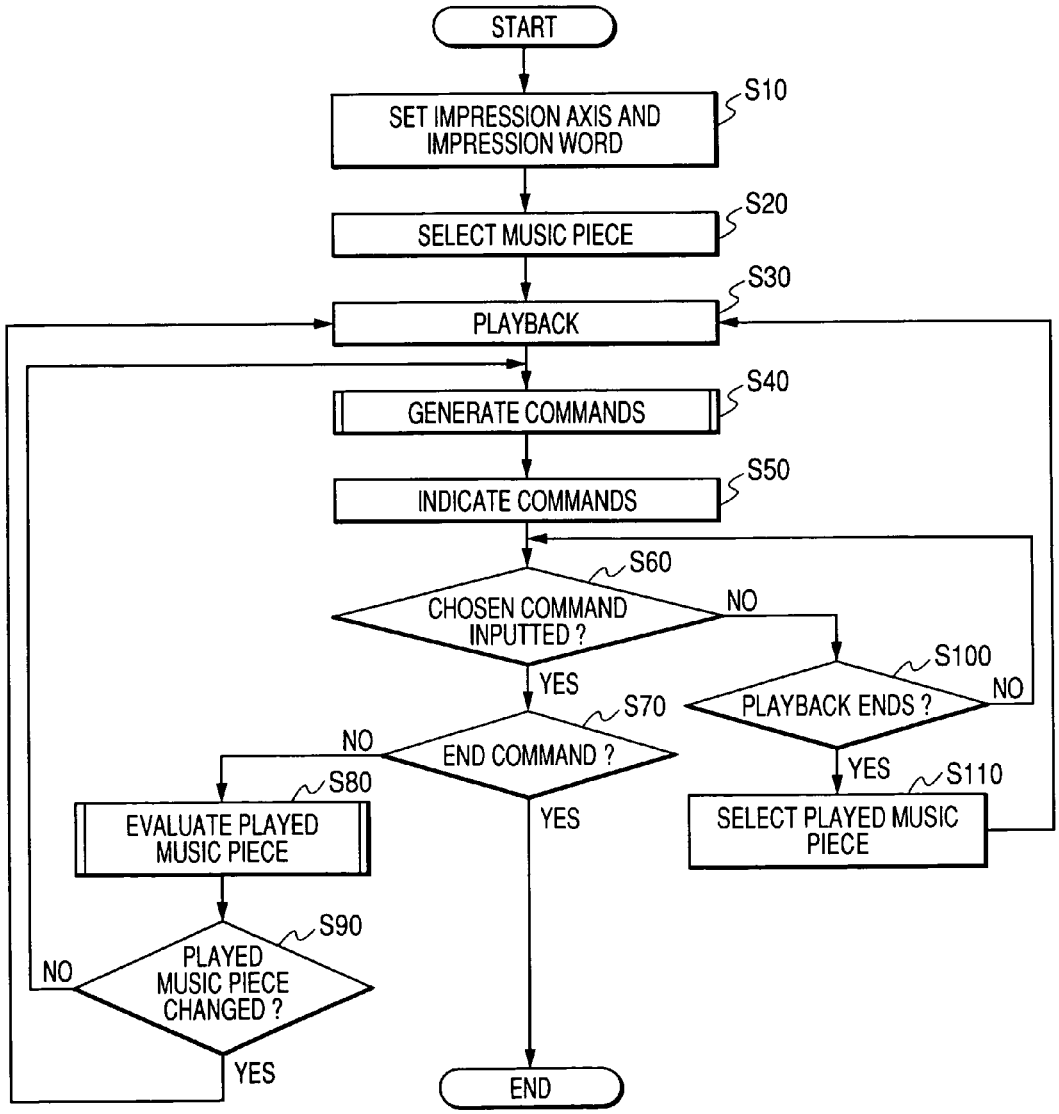
FIG. 13 is a flowchart of a control program for the apparatus in FIG. 1.

FIG. 13 is a flowchart of the control program for the music-piece retrieval and playback apparatus 1. The control program in FIG. 13 starts when the music-piece retrieval and playback apparatus 1 is started to operate. As shown in FIG. 13, a first step S10 of the program sets an initial impression axis and an initial impression word. The step S10 labels the initial impression axis and the initial impression word as a currently-selected impression axis and a currently-selected impression word respectively.

A step S20 following the step S10 refers to the impression data in response to the currently-selected impression word, and thereby detects the content IDs of music pieces corresponding to the currently-selected impression word. Subsequently, the step S20 refers to the preference information in response to the detected content IDs, and thereby detects the degrees of user's preference for respective music pieces having the content IDs same as the detected content IDs. Thereafter, the step S20 selects the greatest one among the detected user's preference degrees. Then, the step S20 labels a music piece corresponding to the greatest user's preference degree as an object to be played back. The music piece to be played back is also called the selected music piece.

Alternatively, the step S20 may randomly select one from the music pieces corresponding to the impression word set by the step S10 or the currently-selected impression word. After the step S20, the program advances to a step S30.

The step S30 transfers a digital audio signal of the selected music piece (the music piece to be played back) from the storage unit 6 to the reproducing device 60. The step S30 controls the reproducing device 60 to play back the selected music piece. After the step S30, the program advances to a block S40.

The block S40 generates commands in the light of the currently-selected impression word and the now-playing music piece. The block S40 assigns ID numbers to the generated commands respectively. As previously mentioned, each of the generated commands has a combination of a corresponding ID number and a message (questionnaire choice information).

A step S50 following the block S40 feeds a picture signal representative of the generated commands to the display 50. The step S50 controls the display 50 to indicate the generated commands. After the step S50, the program advances to a step S60. Usually, the user chooses one from the indicated commands by actuating the input device 10. The actuation of the input device 10 causes a command choice signal representative of the chosen command to be inputted into the apparatus 1.

The step S60 decides whether or not a command choice signal has been inputted by the user through the input device 10. When a command choice signal has been inputted, the program advances from the step S60 to a step S70. Otherwise, the program advances from the step S60 to a step S100.

The step S70 decides whether or not the chosen command represented by the inputted command choice signal is an end command. When the chosen command is an end command, the program exits from the step S70 and then the current execution cycle of the program ends. In this case, the operation of the music-piece retrieval and playback apparatus 1 terminates. When the chosen command is not an end command, the program advances from the step S70 to a block S80.

The block S80 evaluates the now-playing music piece in accordance with the chosen command. The block S80 decides to selectively maintain the now-playing music piece or replace it by new one in response to the result of the evaluation.

A step S90 following the block S80 determines whether or not the now-playing music piece is decided to be replaced by a new one. When the now-playing music piece is decided to be replaced by a new one, the program returns from the step S90 to the step S30. Otherwise, the program returns from the step S90 to the block S40.

The step S100 decides whether or not the playback of the currently-selected music piece has ended. When the playback of the currently-selected music piece has ended, the program advances from the step S100 to a step S110. Otherwise, the program returns from the step S100 to the step S60.

The step S110 selects, from the music pieces, one to be played back which corresponds to the currently-selected impression word, and which has not been played back yet. After the step S110, the program returns to the step S30.

Figure 14:
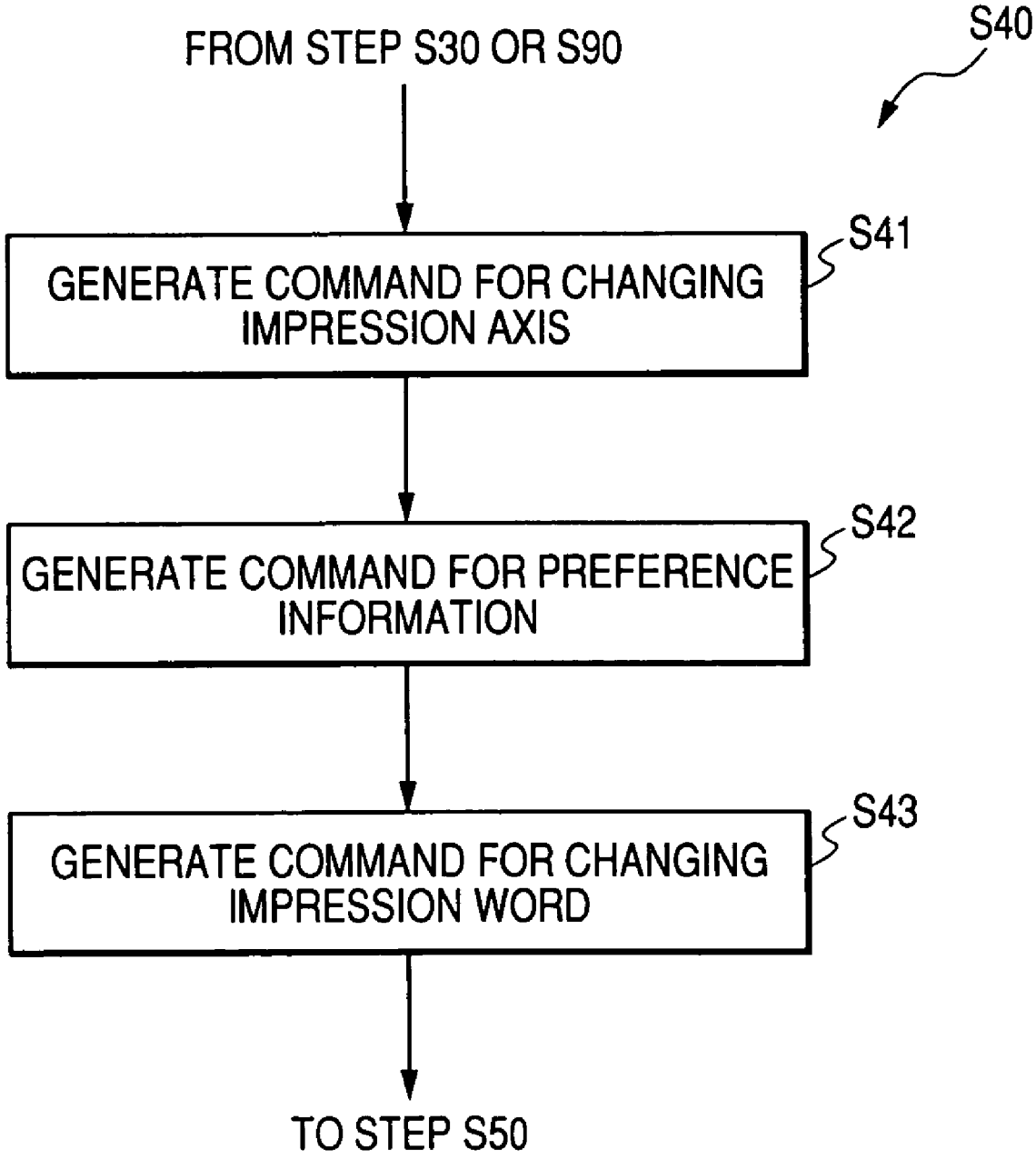
FIG. 14 is a flowchart of a block in FIG. 13.

As shown in FIG. 14, the block S40 has steps S41, S42, and S43. The step S41 follows the step S30 or S90 (see FIG. 13). The step S41 generates a command or commands for changing the currently-selected impression axis.

The step S42 follows the step S41. The step S42 generates commands for the preference information which require the user to increase and decrease the degree of user's preference for the now-playing music piece.

The step S43 follows the step S42. The step S43 generates commands for changing the currently-selected impression word. Furthermore, the step S43 generates other commands including an end command. The step S43 is followed by the step S50 (see FIG. 13).

Figure 15:
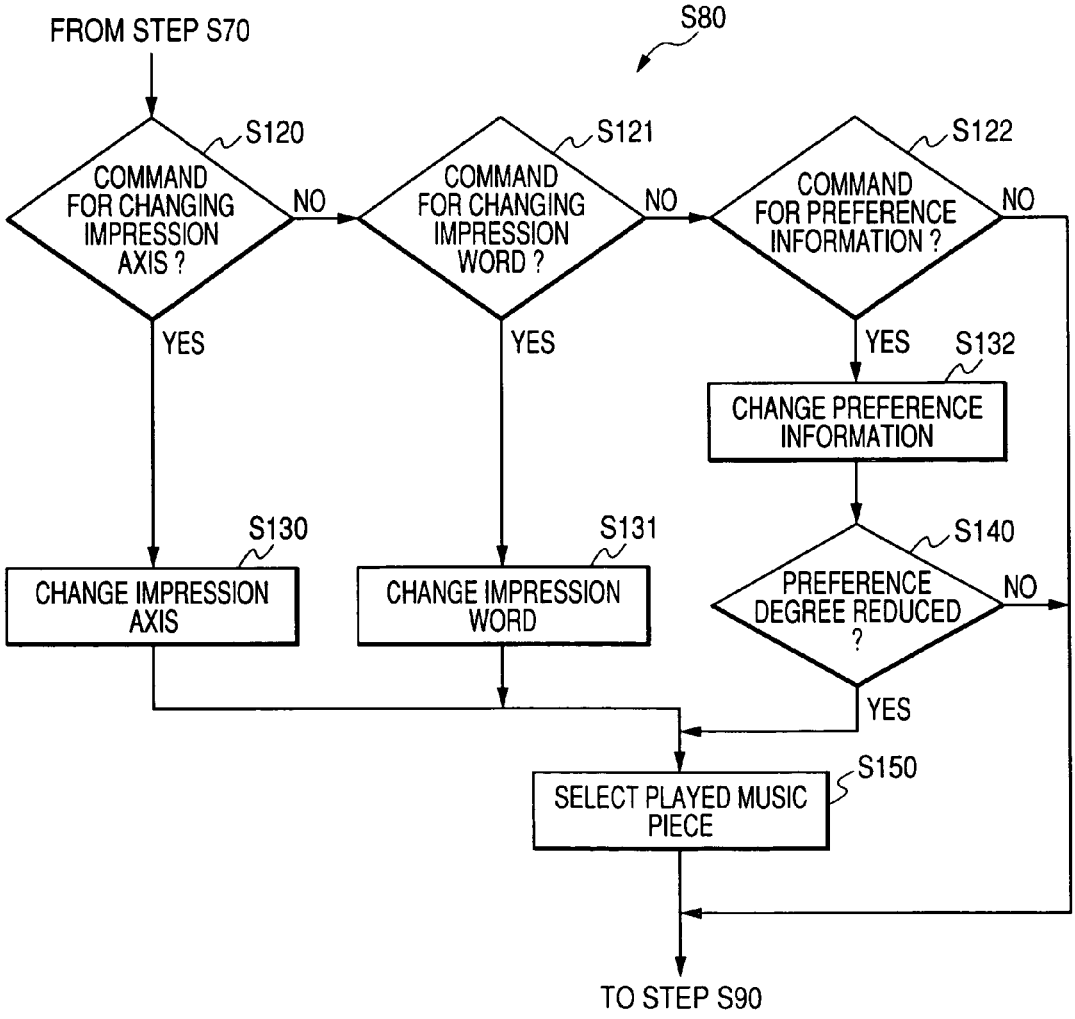
FIG. 15 is a flowchart of another block in FIG. 13.

As shown in FIG. 15, the block S80 includes a step S120 following the step S70 (see FIG. 13). The step S120 decides whether or not the chosen command is for changing the currently-selected impression axis. When the chosen command is for changing the currently-selected impression axis, the program advances from the step S120 to a step S130. Otherwise, the program advances from the step S120 to a step S121.

The step S121 decides whether or not the chosen command is for changing the currently-selected impression word. When the chosen command is for changing the currently-selected impression word, the program advances from the step S121 to a step S131. Otherwise, the program advances from the step S121 to a step S122.

The step S122 decides whether or not the chosen command is for the preference information. When the chosen command is for the preference information, the program advances from the step S122 to a step S132. Otherwise, the program advances from the step S122 to the step S90 (see FIG. 13).

The step S130 updates the currently-selected impression axis by replacing it with another impression axis. Specifically, the step S130 randomly selects an impression axis other than the currently-selected impression axis from the impression axes. Then, the step S130 labels the selected impression axis as the currently-selected impression axis. The step S130 does not select impression axes which have been selected once. After the updating of the currently-selected impression axis, the step S130 updates the currently-selected impression word by replacing it with another impression word. Specifically, the step S130 randomly selects one from the impression words in the currently-selected impression axis. Then, the step S130 labels the selected impression word as the currently-selected impression word. After the step S130, the program advances to a step S150.

The step S131 updates the currently-selected impression word by replacing it with another impression word. Specifically, the step S131 retrieves the rank of the currently-selected impression word from the storage unit 6. Then, the impression-word changing block 22 replaces the currently-selected impression word by another impression word in the currently-selected impression axis in accordance with the chosen command and the obtained rank. After the step S131, the program advances to the step S150.

The step S132 reads out, from the storage unit 6, the preference information representing the user's preference degree for the now-playing music piece. The step S132 updates (that is, increases or decreases) the user's preference degree for the now-playing music piece in accordance with the chosen command. The step S132 writes information representative of the updated user's preference degree for the now-playing music piece over the old information in the storage unit 6.

A step S140 following the step S132 decides whether or not the user's preference degree for the now-playing music piece has been decreased. When the user's preference degree for the now-playing music piece has been decreased, the program advances from the step S140 to the step S150. Otherwise, the program advances from the step S140 to the step S90 (see FIG. 13).

The step S150 changes the selected music piece (the now-playing music piece). Specifically, the step S150 refers to the impression data in response to the currently-selected impression word, and thereby detects the content IDs of music pieces corresponding to the currently-selected impression word. Subsequently, the step S150 randomly selects, from the detected content IDs, one other than the content ID of the now-playing music piece. Then, the step S150 labels the music piece having the selected content ID as an object to be played back, that is, a selected music piece. After the step S150, the program advances to the step S90 (see FIG. 13).

The music-piece retrieval and playback apparatus 1 allows the user to search for a desired music piece while utilizing a now-playing music piece as a reference. The user is easily enabled to have user's feelings about the now-playing music piece. The search for the desired music piece can be performed by intuition.

It is easy to input a command choice signal into the music-piece retrieval and playback apparatus 1. Complicated user's operation is unnecessary for the inputting of a command choice information. The music-piece retrieval and playback apparatus 1 can be provided in a small-size portable device, a CD player, or an MD player.

It is unnecessary for the user to search lists for a desired impression word and a desired music piece. It is unnecessary for the user to input a text and words into the music-piece retrieval and playback apparatus 1. The user can easily handle the music-piece retrieval and playback apparatus 1. It is possible for the user to find a desired piece without performing complicated operation.

SECOND EMBODIMENT

Figure 16:
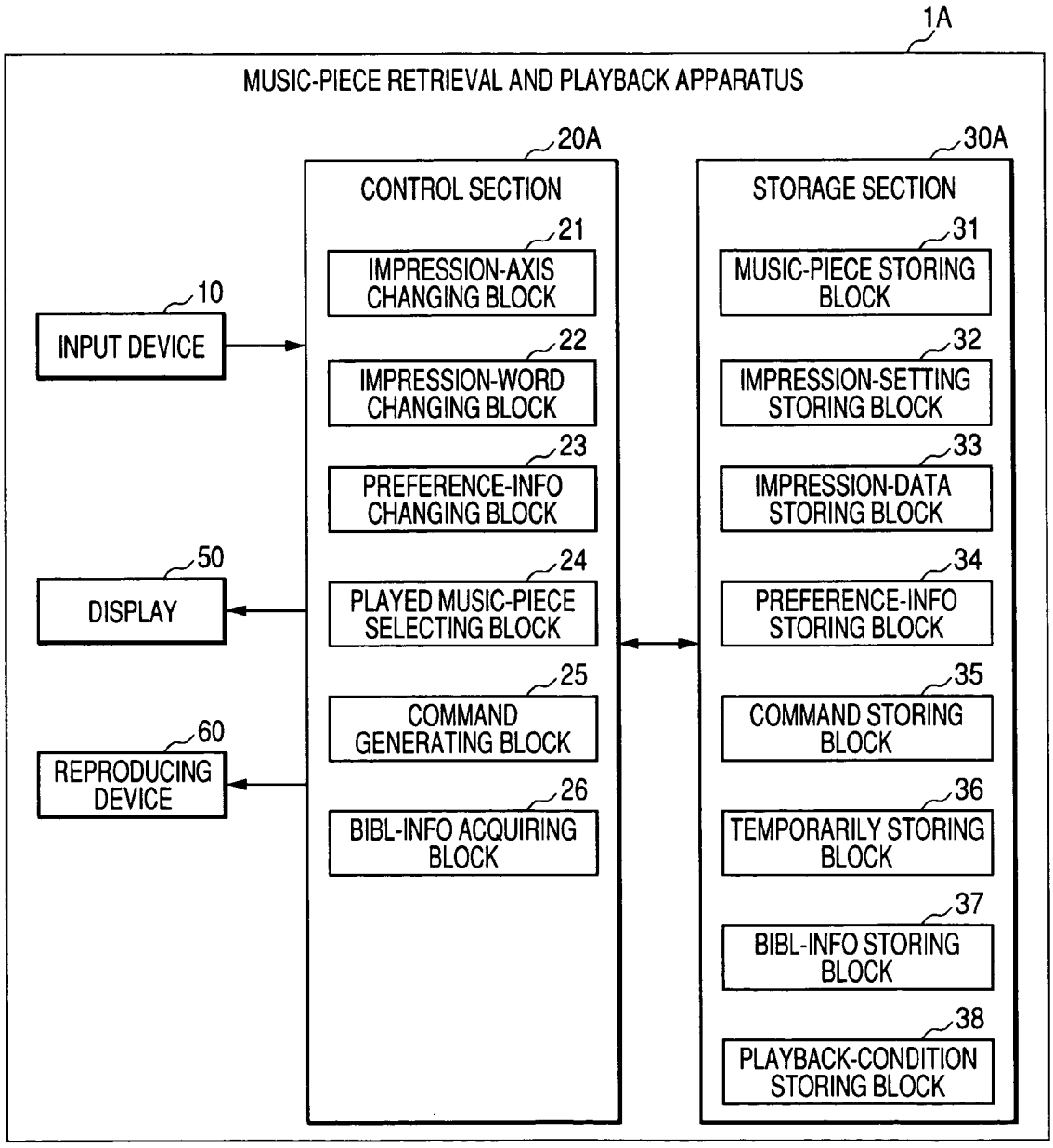
FIG. 16 is an operation diagram of a music-piece retrieval and playback apparatus according to a second embodiment of this invention.

FIG. 16 basically shows the operation of a music-piece retrieval and playback apparatus 1A according to a second embodiment of this invention. The music-piece retrieval and playback apparatus 1A is similar to the music-piece retrieval and playback apparatus 1 (see FIGS. 1 and 2) except for design changes mentioned hereafter.

As shown in FIG. 16, a major portion of the music-piece retrieval and playback apparatus 1A is divided into a control section 20A and a storage section 30A which replace the control section 20 and the storage section 30 (see FIG. 2). The control section 20A implements a bibliographic-information acquiring block 26. The storage section 30A implements a bibliographic-information storing block 37 and a playback-condition storing block 38.

The bibliographic-information acquiring block 26 reads out a bibliographic information segment about each music piece from the bibliographic-information storing block 37. The bibliographic information segment about the music piece represents the title, the artist name, the genre, and the year of the music piece.

The bibliographic-information storing block 37 stores bibliographic information segments about the respective music pieces represented by the digital audio signals in the music-piece storing block 31. The music pieces represented by the digital audio signals in the music-piece storing block 31 and the bibliographic information segments in the bibliographic-information storing block 37 are made in a relation utilizing the content IDs.

Preferably, the bibliographic-information storing block 37 is formed by the storage unit 6 (see FIG. 1). Thus, the bibliographic information segments are stored in the storage unit 6.

Figures 17, 18:
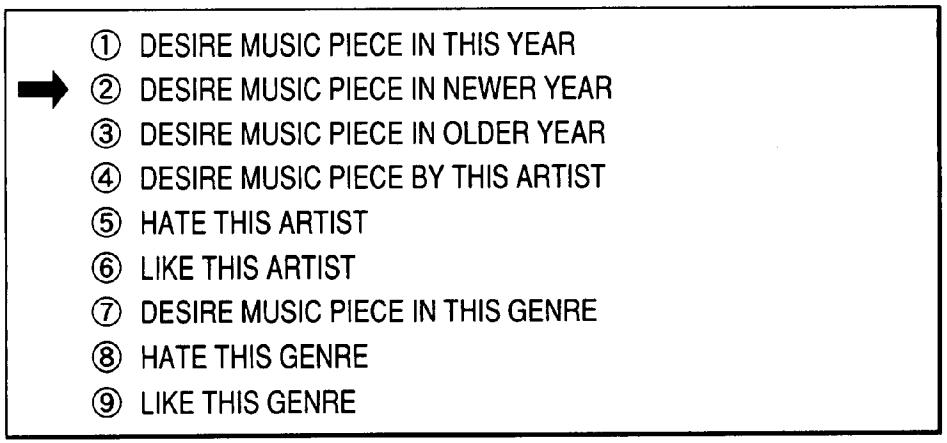
FIG. 17 is a diagram showing an example of the format of bibliographic information segments in a bibliographic-information storing block in FIG. 16.
FIG. 18 is a diagram showing an example of a picture indicated by a display in FIG. 16.

FIG. 17 shows an example of the format of bibliographic information segments in the bibliographic-information storing block 37. In FIG. 17, rows denote bibliographic information segments respectively. A bibliographic information segment in each row represents the content ID, the title, the artist name, the genre, and the year of a corresponding music piece.

The playback-condition storing block 38 stores information (playback-condition information) representative of conditions for selecting a music piece or pieces to be played back. At the start of the music-piece retrieval and playback apparatus 1A, no playback-condition information is stored in the playback-condition storing block 38. In the absence of playback-condition information from the playback-condition storing block 38, a music piece is selected in accordance with a currently-selected impression word.

During the playback of the selected music piece, the command generating block 25 generates commands on the basis of the bibliographic information segment about the now-playing music piece. The generated commands are designed for requiring the user to input a command choice signal into the apparatus 1A through the input device 10. Identification (ID) numbers are assigned to the generated commands, respectively. Each of the generated commands has a combination of a corresponding ID number and a message (questionnaire choice information).

Commands designed for requiring the user to input a command choice signal into the apparatus 1A include year-based commands, artist-based commands, and genre-based commands.

FIG. 18 shows an example of a picture indicated by the display 50 which includes ID numbers and messages (questionnaire choice information) in commands generated by the command generating block 25 for requiring the user to input a command choice signal into the apparatus 1A. In FIG. 18, the ID numbers precede the corresponding messages respectively.

With reference to FIG. 18, a first year-based command has a combination of an ID number of ① and a message of "desire music piece in this year". Here, "this year" means not only this year but also a 5-year range centered at this year (the year of the release of the music piece). A second year-based command has a combination of an ID number of ② and a message of "desire music piece in newer year". A third year-based command has a combination of an ID number of ③ and a message of "desire music piece in older year". A first artist-based command has a combination of an ID number of ④ and a message of "desire music piece by this artist". A second artist-based command has a combination of an ID number of ⑤ and a message of "hate this artist". A third artist-based command has a combination of an ID number of ⑥ and a message of "like this artist". A first genre-based command has a combination of an ID number of ⑦ and a message of "desire music piece in this genre". A second genre-based command has a combination of an ID number of ⑧ and a message of "hate this genre". A third genre-based command has a combination of an ID number of ⑨ and a message of "like this genre".

The bibliographic-information acquiring block 26 reads out a bibliographic information segment about the now-playing music piece from the bibliographic-information storing block 37 in response to the content ID of the now-playing music piece. The read-out bibliographic information segment represents the title, the artist name, the genre, and the year of the now-playing music piece. The bibliographic-information acquiring block 26 detects the year of the now-playing music piece from the read-out bibliographic information segment. The bibliographic-information acquiring block 26 decides whether or not a year-based command can be utilized on the basis of the detected year of the now-playing music piece. In the case where the detected year of the now-playing music piece is the newest among the years of the music pieces which are registered in the bibliographic-information storing block 37, the year-based command having a message of "desire music piece in newer year" can not be utilized. On the other hand, in the case where the detected year of the now-playing music piece is the oldest among the years of the music pieces which are registered in the bibliographic-information storing block 37, the year-based command having a message of "desire music piece in older year" can not be utilized. The command generating block 25 will not generate a command which can not be utilized.

In the case where the chosen command differs from the end command, the control section 20A evaluates the now-playing music piece in accordance with the chosen command. The details of the evaluation are as follows. First, the control section 20A decides whether or not the chosen command is a year-based command on the basis of the ID number of the chosen command.

When the chosen command is not a year-based command, the control section 20A further decides whether or not the chosen command is an artist-based command on the basis of the ID number of the chosen command.

When the chosen command is not an artist-based command, the control selection 20A further decides whether or not the chosen command is a genre-based command on the basis of the ID number of the chosen command. In the case where the chosen command is not a genre-based command, the playback-object music-piece selecting block 24 does not change the now-playing music piece and then the control section 20A terminates the evaluation of the now-playing music piece.

In the case where the control section 20A decides that the chosen command is a year-based command, the bibliographic-information acquiring block 26 retrieves the content ID of the now-playing music piece from the temporarily storing block 36. Then, the bibliographic-information acquiring block 26 retrieves the year of the now-playing music piece from the bibliographic-information storing block 37 in response to the content ID of the now-playing music piece. The control section 20A decides whether the chosen year-based command has a message of "desire music piece in this year", a message of "desire music piece in newer year", or a message of "desire music piece in older year".

In the case where the chosen year-based command has a message of "desire music piece in this year", the control section 20A loads the playback-condition storing block 38 with information (playback-condition information) representing that a prescribed number of music pieces in years equal to and around the year of the now-playing music piece should be played back. The playback-condition information contains the content IDs of the music pieces described therein. For example, when the year of the now-playing music piece is 1990 and a 5-year range centered at the year of the now-playing music piece is set, the control section 20A loads the playback-condition storing block 38 with information representing that a prescribed number of music pieces in 1988-1992 should be played back.

In the case where the chosen year-based command has a message of "desire music piece in newer year", the playback-object music-piece selecting block 24 retrieves the years of music pieces other than the now-playing music piece from the bibliographic-information storing block 37 and randomly selects one from music pieces in years in a prescribed year range newer than the year of the now-playing music piece. For example, when the year of the now-playing music piece is 1980 and the prescribed year range is between a 5-year point and a 10-year point, the playback-object music-piece selecting block 24 randomly selects one from music pieces in years in the range of 1985 to 1990.

In the case where the chosen year-based command has a message of "desire music piece in older year", the playback-object music-piece selecting block 24 retrieves the years of music pieces other than the now-playing music piece from the bibliographic-information storing block 37 and randomly selects one from music pieces in years in a prescribed year range older than the year of the now-playing music piece. For example, when the year of the now-playing music piece is 1980 and the prescribed year range is between a 5-year point and a 10-year point, the playback-object music-piece selecting block 24 randomly selects one from music pieces in years in the range of 1970 to 1975.

When the above-mentioned operation responsive to the chosen year-based command is completed, the control section 20A terminates the evaluation of the now-playing music piece.

In the case where the control section 20A decides that the chosen command is an artist-based command, the bibliographic-information acquiring block 26 retrieves the content ID of the now-playing music piece from the temporarily storing block 36. Then, the bibliographic-information acquiring block 26 retrieves the artist of the now-playing music piece from the bibliographic-information storing block 37 in response to the content ID of the now-playing music piece. Subsequently, the control section 20A performs either a first artist-responsive process or a second artist-responsive process.

The first artist-responsive process is as follows. The control section 20A selects a prescribed number of music pieces by the artist same as that of the now-playing music piece. The control section 20A loads the playback-condition storing block 38 with information (playback-condition information) representing that the prescribed number of music pieces by the artist same as that of the now-playing music piece should be played back. The playback-condition information contains the content IDs of the music pieces described therein.

The second artist-responsive process is as follows. The control section 20A increases or decreases the user's preference degrees for music pieces by the artist same as that of the now-playing music piece. Specifically, the control section 20A searches the bibliographic-information storing block 37 for content IDs corresponding to the artist same as that of the now-playing music piece. The control section 20A accesses the preference-information storing block 34 to increase or decrease the user's preference degrees for the music pieces having the search-result content IDs by a prescribed value in response to the chosen artist-based command. In the case where the chosen artist-based command has a message of "hate this artist", the control section 20A decreases the user's preference degrees for the music pieces by the prescribed value. On the other hand, in the case where the chosen artist-based command has a message of "like this artist", the control section 20A increases the user's preference degrees for the music pieces by the prescribed value. When the user's preference degrees for the music pieces are decreased, the control section 20A clears the playback-condition information in the playback-condition storing block 38.

In the case where the control section 20A decides that the chosen command is a genre-based command, the bibliographic-information acquiring block 26 retrieves the content ID of the now-playing music piece from the temporarily storing block 36. Then, the bibliographic-information acquiring block 26 retrieves the genre of the now-playing music piece from the bibliographic-information storing block 37 in response to the content ID of the now-playing music piece. Subsequently, the control section 20A performs either a first genre-responsive process or a second genre-responsive process.

The first genre-responsive process is as follows. The control section 20A selects a prescribed number of music pieces in the genre same as that of the now-playing music piece. The control section 20A loads the playback-condition storing block 38 with information (playback-condition information) representing that the prescribed number of music pieces in the genre same as that of the now-playing music piece should be played back. The playback-condition information contains the content IDs of the music pieces described therein.

The second genre-responsive process is as follows. The control section 20A increases or decreases the user's preference degrees for music pieces in the genre same as that of the now-playing music piece. Specifically, the control section 20A searches the bibliographic-information storing block 37 for content IDs corresponding to the genre same as that of the now-playing music piece. The control section 20A accesses the preference-information storing block 34 to increase or decrease the user's preference degrees for the music pieces having the search-result content IDs by a prescribed value in response to the chosen genre-based command. In the case where the chosen genre-based command has a message of "hate this genre", the control section 20A decreases the user's preference degrees for the music pieces by the prescribed value. On the other hand, in the case where the chosen genre-based command has a message of "like this genre", the control section 20A increases the user's preference degrees for the music pieces by the prescribed value. When the user's preference degrees for the music pieces are decreased, the control section 20A clears the playback-condition information in the playback-condition storing block 38.

After performing the first artist-responsive process or the second artist-responsive process or performing the first genre-responsive process or the second genre-responsive process, the control section 20A decides whether or not the user's preference degrees have been decreased. When the user's preference degrees have not been decreased, the playback-object music-piece selecting block 24 does not change the now-playing music piece and then the control section 20A terminates the evaluation of the now-playing music piece. On the other hand, when the user's preference degrees have been decreased, the playback-object music-piece selecting block 24 changes the now-playing music piece as in the first embodiment of this invention. Subsequently, the control section 20A terminates the evaluation of the now-playing music piece.

The control section 20A decides whether or not the playback of the currently-selected music piece has ended as the control section 20 does in the first embodiment of this invention. In the case where the playback of the currently-selected music piece has ended, the playback-object music-piece selecting block 24 reads out the playback-condition information from the playback-condition storing block 38 and selects one from the music pieces in response to the read-out playback-condition information as an object to be played back. Specifically, the playback-object music-piece selecting block 24 searches the bibliographic-information storing block 37 for bibliographic information segments meeting the playback-conditions represented by the read-out playback-condition information. Then, the playback-object music-piece selecting block 24 randomly selects one from the content IDs corresponding to the search-result bibliographic information segments. Subsequently, the playback-object music-piece selecting block 24 labels the music piece having the selected content ID as an object to be played back (a selected music piece).

During the selection of a music piece to be played back, the playback-object music-piece selecting block 24 refers to the preference-information storing block 34 to detect the degrees of user's preference for the music pieces having the content IDs corresponding to the search-result bibliographic information segments. The playback-object music-piece selecting block 24 compares the detected user's preference degrees with a prescribed value. The playback-object music-piece selecting block 24 does not select a music piece corresponding to a detected user's preference degree less than the prescribed value. Furthermore, the playback-object music-piece selecting block 24 refers to the information stored in the temporarily storing block 36, and does not select a music piece which has already been played back. Subsequently, the playback-object music-piece selecting block 24 loads the temporarily storing block 36 with information representing the content ID of the selected music piece as the content ID of a now-playing music piece and the content ID of a music piece which has already been played back. In addition, the playback-object music-piece selecting block 24 loads the temporarily storing block 36 with information representing the number of times of the execution of the music-piece selection responsive to the playback conditions.

In the case where the playback of the prescribed number of music pieces described in the playback-condition information in the playback-condition storing block 38 has been completed, or in the case where a music piece meeting the playback conditions is absent, the playback-object music-piece selecting block 24 clears the playback-condition information in the playback-condition storing block 38. Then, the playback-object music-piece selecting block 24 selects a music piece to be played back in a way similar to that in the first embodiment of this invention.

The selection of a music piece to be played back may be responsive to the user's preference degrees. In this case, the control section 20A obtains the content IDs of the music pieces which meet the playback conditions. The control section 20A retrieves the user's preference degrees corresponding to the obtained content IDs from the preference-information storing block 34. Then, the playback-object music-piece selecting block 24 selects one from the retrieved user's preference degrees in the priority order where a higher priority is given to a higher degree. It is preferable that the retrieved user's preference degrees lower than a prescribed value are not selected. Subsequently, the playback-object music-piece selecting block 24 labels a music piece corresponding to the selected user's preference degree as an object to be played back.

For example, when the playback-condition information stored in the playback-condition storing block 38 is based on the artist, the playback-object music-piece selecting block 24 searches the bibliographic-information storing block 37 for the content IDs of music pieces by the artist. Then, the playback-object music-piece selecting block 24 randomly selects one from the search-result content IDs. Subsequently, the playback-object music-piece selecting block 24 labels a music piece having the selected content ID as an object to be played back.

Figure 19:
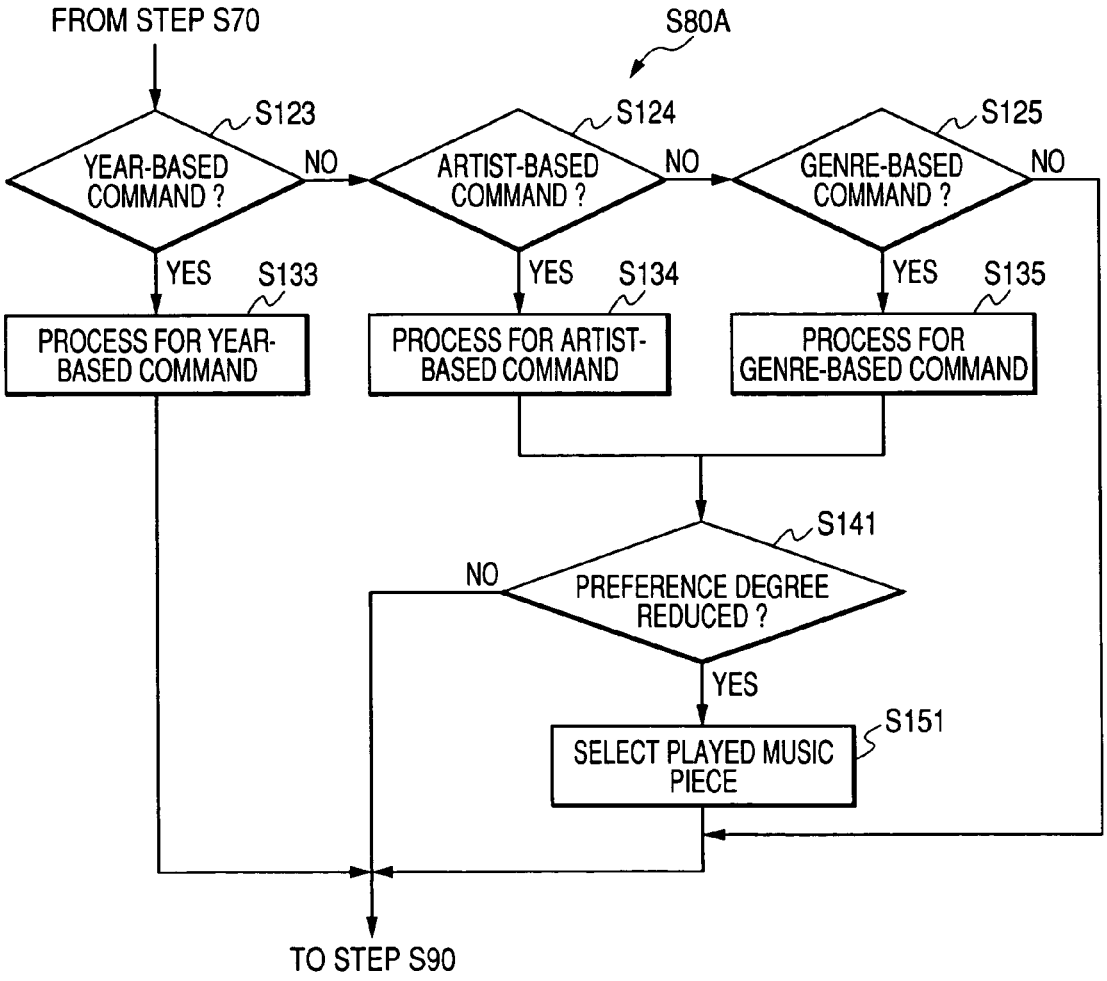
FIG. 19 is a flowchart of a block in a control program for the apparatus in FIG. 16.

FIG. 19 shows a block S80A in a control program for the music-piece retrieval and playback apparatus 1A. The block S80A replaces the block S80 in FIG. 15.

As shown in FIG. 19, the block S80A includes a step S123 following the step S70 (see FIG. 13). The step S123 decides whether or not the chosen command is a year-based command. When the chosen command is a year-based command, the program advances from the step S123 to a step S133. Otherwise, the program advances from the step S123 to a step S124.

The step S124 decides whether or not the chosen command is an artist-based command. When the chosen command is an artist-based command, the program advances from the step S124 to a step S134. Otherwise, the program advances from the step S124 to a step S125.

The step S125 decides whether or not the chosen command is a genre-based command. When the chosen command is a genre-based command, the program advances from the step S125 to a step S135. Otherwise, the program advances from the step S125 to the step S90 (see FIG. 13).

The step S133 derives the year of the now-playing music piece from the bibliographic information in the storage unit 6. The step S133 decides whether the chosen year-based command has a message of "desire music piece in this year", a message of "desire music piece in newer year", or a message of "desire music piece in older year".

In the case where the chosen year-based command has a message of "desire music piece in this year", the step S133 searches the bibliographic information in the storage unit 6 for content IDs of a prescribed number of music pieces in years equal to and around the year of the now-playing music piece. Then, the step S133 loads the RAM 5 with information (playback-condition information) representing that the prescribed number of music pieces in years equal to and around the year of the now-playing music piece should be played back. The playback-condition information contains the content IDs of the music pieces described therein.

In the case where the chosen year-based command has a message of "desire music piece in newer year", the step S133 searches the bibliographic information in the storage unit 6 for content IDs of music pieces in years in a prescribed year range newer than the year of the now-playing music piece. Then, the step S133 randomly selects one from the search-result content IDs. Subsequently, the step S133 labels the music piece having the selected content ID as an object to be played back. Thus, a music piece to be played back is selected.

In the case where the chosen year-based command has a message of "desire music piece in older year", the step S133 searches the bibliographic information in the storage unit 6 for content IDs of music pieces in years in a prescribed year range older than the year of the now-playing music piece. Then, the step S133 randomly selects one from the search-result content IDs. Subsequently, the step S133 labels the music piece having the selected content ID as an object to be played back. Thus, a music piece to be played back is selected.

After the step S133, the program advances to the step S90 (see FIG. 13).

The step S134 derives the artist of the now-playing music piece from the bibliographic information in the storage unit 6. Subsequently, the step S134 performs either a first artist-responsive process or a second artist-responsive process. The first artist-responsive process is as follows. The step S134 searches the bibliographic information in the storage unit 6 for content IDs of a prescribed number of music pieces by the artist same as that of the now-playing music piece. The step S134 loads the RAM 5 with information (playback-condition information) representing that the prescribed number of music pieces by the artist same as that of the now-playing music piece should be played back. The playback-condition information contains the content IDs of the music pieces described therein. The playback-condition information will be used by the step S110. The second artist-responsive process is as follows. The step S134 searches the bibliographic information in the storage unit 6 for content IDs corresponding to the artist same as that of the now-playing music piece. The step S134 updates the preference information in the storage unit 6, thereby increasing or decreasing the user's preference degrees for the music pieces having the search-result content IDs by a prescribed value in response to the chosen artist-based command. The first artist-responsive process and the second artist-responsive process correspond to the artist-based command having a combination of an ID number of ④ and a message of "desire music piece by this artist", the artist-based command having a combination of an ID number of ⑤ and a message of "hate this artist", and the artist-based command having a combination of an ID number of ⑥ and a message of "like this artist" in FIG. 18. After the step S134, the program advances to a step S141.

The step S135 derives the genre of the now-playing music piece from the bibliographic information in the storage unit 6. Subsequently, the step S135 performs either a first genre-responsive process or a second genre-responsive process. The first genre-responsive process is as follows. The step S135 searches the bibliographic information in the storage unit 6 for content IDs of a prescribed number of music pieces in the genre same as that of the now-playing music piece. The step S135 loads the RAM 5 with information (playback-condition information) representing that the prescribed number of music pieces in the genre same as that of the now-playing music piece should be played back. The playback-condition information contains the content IDs of the music pieces described therein. The second genre-responsive process is as follows. The step S135 searches the bibliographic information in the storage unit 6 for content IDs corresponding to the genre same as that of the now-playing music piece. The step S135 updates the preference information in the storage unit 6, thereby increasing or decreasing the user's preference degrees for the music pieces having the search-result content IDs by a prescribed value in response to the chosen genre-based command. The first genre-responsive process and the second genre-responsive process correspond to the genre-based command having a combination of an ID number of ⑦ and a message of "desire music piece in this genre", the genre-based command having a combination of an ID number of ⑧ and a message of "hate this genre", and the genre-based command having a combination of an ID number of ⑨ and a message of "like this genre" in FIG. 18. After the step S135, the program advances to the step S141.

The step S141 decides whether or not the user's preference degrees have been decreased. When the user's preference degrees have been decreased, the program advances from the step S141 to a step S151. Otherwise, the program advances from the step S141 to the step S90 (see FIG. 13).

The step S151 changes the selected music piece as the step S150 in FIG. 15 does. After the step S151, the program advances to the step S90 (see FIG. 13).

The step S110 (see FIG. 13) reads out the playback-condition information from the RAM 5, and selects one from the music pieces described in the read-out playback-condition information as an object to be played back.

It is possible to meet user's need to continuously listen to music pieces by this artist, music pieces in this year, or music pieces in this genre. Utilizing all of "year", "genre", and "artist" is not necessary.

It should be noted that a desired music piece may be retrieved and played back through the use of a search based on an arbitrary combination of bibliographic information segments representing the artist names, the genres, and the years of stored music pieces.

THIRD EMBODIMENT

Figure 20:
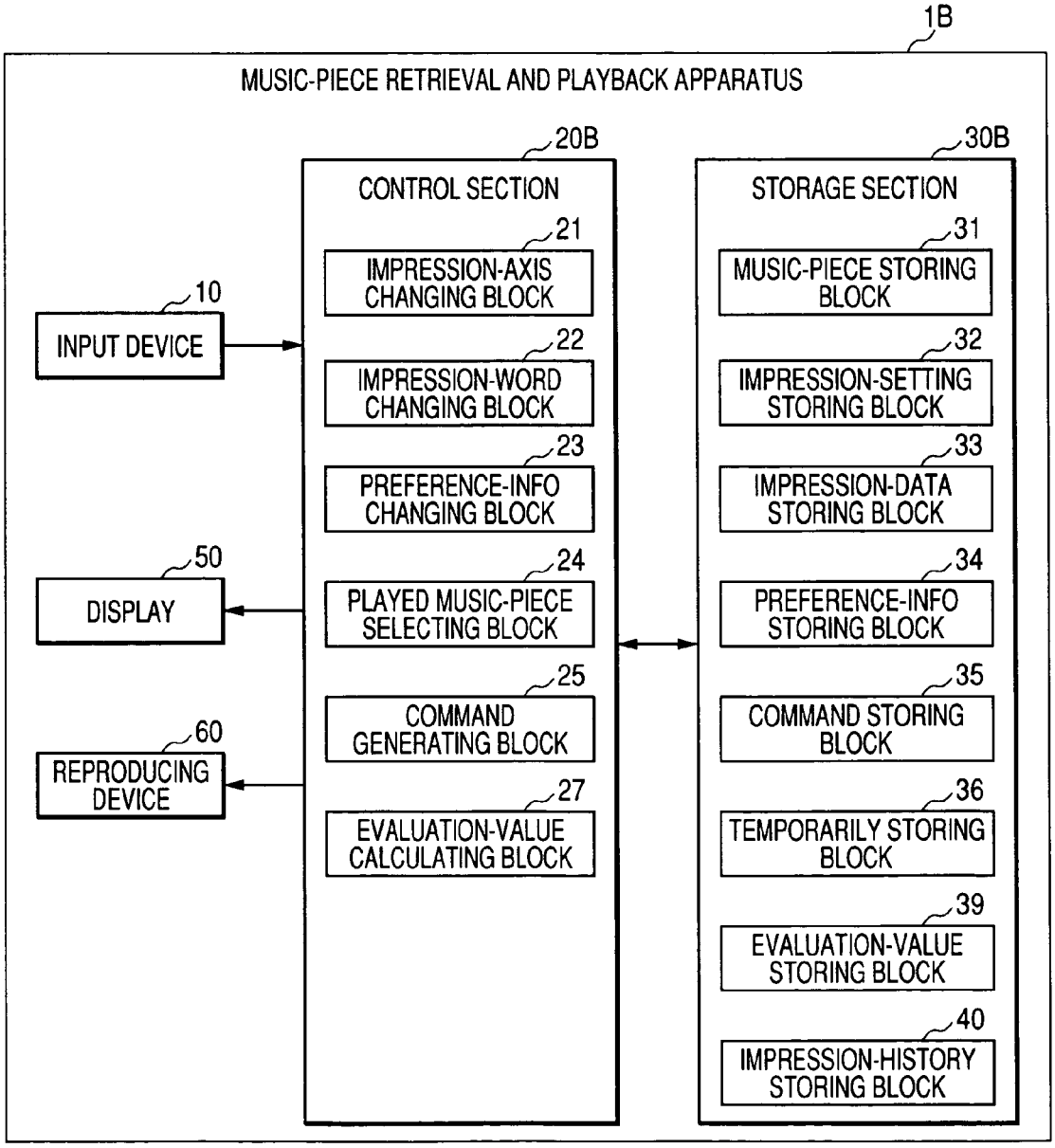
FIG. 20 is an operation diagram of a music-piece retrieval and playback apparatus according to a third embodiment of this invention.

FIG. 20 basically shows the operation of a music-piece retrieval and playback apparatus 1B according to a third embodiment of this invention. The music-piece retrieval and playback apparatus 1B is similar to the music-piece retrieval and playback apparatus 1 (see FIGS. 1 and 2) except for design changes mentioned hereafter.

As shown in FIG. 20, a major portion of the music-piece retrieval and playback apparatus 1B is divided into a control section 20B and a storage section 30B which replace the control section 20 and the storage section 30 (see FIG. 2). The control section 20B implements an estimation-value calculating block 27. The storage section 30B implements an estimation-value storing block 39 and an impression-history storing block 40.

The evaluation-value calculating block 27 calculates the evaluation value of each impression word or the evaluation value of each relation between impression axes in accordance with a command chosen by the user. The evaluation-value storing block 39 stores information representing the evaluation values calculated by the evaluation-value calculating block 27. The impression-history storing block 40 stores information representing the currently-selected impression axis made to correspond to a time order in the case where the currently-selected impression axis remains unchanged for a predetermined time or in the case where the playback of a music piece corresponding to the currently-selected impression axis is repeated a prescribed number of times.

The music-piece retrieval and playback apparatus 1B operates as follows. When the music-piece retrieval and playback apparatus 1B is started, the control section 20B sets an initial impression axis and an initial impression word. The control section 20B loads the temporarily storing block 36 with information representing the initial impression axis and the initial impression word as a currently-selected impression axis and a currently-selected impression word. Simultaneously, the control section 20B loads the impression-history storing block 40 with information (time information) representing the present time and information representing the initial impression axis and the initial impression word (the currently-selected impression axis and the currently-selected impression word).

When a command chosen by the user is inputted into the apparatus 1B, the evaluation-value calculating block 27 performs a process responsive to the inputted command (the chosen command). When a command chosen by the user is not inputted into the apparatus 1B, the control section 20B decides whether or not the currently-selected impression axis is in a stay state on the basis of the time information in the impression-history storing block 40. Furthermore, the control section 20B decides whether or not the currently-selected impression word is in a stay state on the basis of the time information in the impression-history storing block 40. The stay state of the currently-selected impression axis means a condition where the currently-selected impression axis remains unchanged for a predetermined time or the playback of a music piece corresponding to the currently-selected impression axis is repeated a prescribed number of times. The stay state of the currently-selected impression word means a condition where the currently-selected impression word remains unchanged for a predetermined time or the playback of a music piece corresponding to the currently-selected impression word is repeated a prescribed number of times. When the currently-selected impression axis is in the stay state, the control section 20B concludes that the currently-selected impression axis matches atmospheres desired by the user. When the currently-selected impression word is in the stay state, the control section 20B concludes that the currently-selected impression word matches atmospheres desired by the user.

Each time the currently-selected impression axis is changed, the control section 20B loads the impression-history storing block 40 with information (time information) representing the present time and information representing the newly-selected impression axis. Each time the currently-selected impression word is changed, the control section 20B loads the impression-history storing block 40 with information (time information) representing the present time and information representing the newly-selected impression word. In this way, the control section 20B updates the time information in the impression-history storing block 40 when the currently-selected impression axis or the currently-selected impression word is changed. The time information represents the time of the change of the currently-selected impression axis or the currently-selected impression word.

The control section 20B derives the time of the last change of the currently-selected impression axis from the time information in the impression-history storing block 40. The control section 20B compares the derive time and the present time to determine whether or not a predetermined time has elapsed from the time of the last change of the currently-selected impression axis. When the predetermined time has elapsed, the control section 20B decides that the currently-selected impression axis is in the stay state. In this case, the control section 20B loads the impression-history storing block 40 with information representing that the currently-selected impression axis is in the stay state.

The control section 20B derives the time of the last change of the currently-selected impression word from the time information in the impression-history storing block 40. The control section 20B compares the derive time and the present time to determine whether or not a predetermined time has elapsed from the time of the last change of the currently-selected impression word. When the predetermined time has elapsed, the control section 20B decides that the currently-selected impression word is in the stay state. In this case, the control section 20B loads the impression-history storing block 40 with information representing that the currently-selected impression word is in the stay state.

Figures 21, 22:
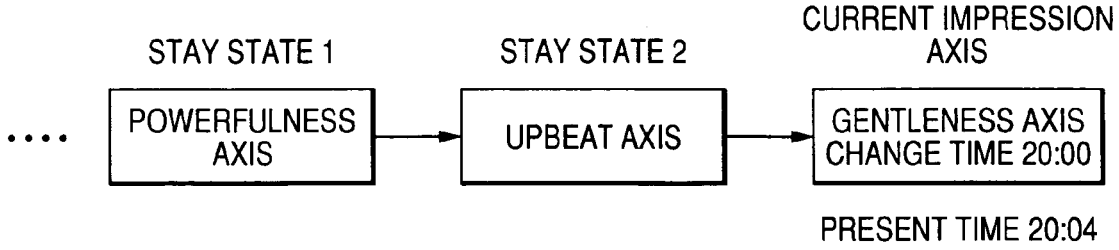
FIG. 21 is a diagram of an example of a time-domain change in a currently-selected impression axis.
FIG. 22 is a diagram showing an example of the format of first information in an evaluation-value storing block in FIG. 20.

FIG. 21 shows an example of a portion of the information in the impression-history storing block 40. With reference to FIG. 21, the impression axis "powerfulness" is in the stay state, and then the impression axis "upbeat" is in the stay state. Thereafter, the currently-selected impression axis is changed from "upbeat" to "gentleness" at a time of 20:00. In FIG. 21, the present time is 20:04.

When the number of times the playback of a music piece corresponding to the currently-selected impression axis is repeated exceeds a prescribed value, the control section 20B decides that the currently-selected impression axis is in the stay state. In this case, the control section 20B loads the impression-history storing block 40 with information representing the number of times of the playback. When the number of times the playback of a music piece corresponding to the currently-selected impression word is repeated exceeds a prescribed value, the control section 20B decides that the currently-selected impression word is in the stay state. In this case, the control section 20B loads the impression-history storing block 40 with information representing the number of times of the playback.

In the case where the chosen command differs from the end command, the evaluation-value calculating block 27 performs either a first evaluation-value calculating process or a second evaluation-value calculating process.

The first evaluation-value calculating process is as follows. The evaluation-value calculating block 27 refers to the impression-history storing block 40 to detect whether or not the currently-selected impression word is in the stay state. When the currently-selected impression word is not in the stay state, the first evaluation-value calculating process terminates. On the other hand, when the currently-selected impression word is in the stay state, the evaluation-value calculating block 27 calculates the evaluation value of the currently-selected impression word. Specifically, the evaluation-value calculating block 27 obtains the latest evaluation value Qi of the currently-selected impression word from the evaluation-value storing block 39. The evaluation-value calculating block 27 updates the evaluation value Qi according to an equation as "$Qi=(1-\alpha)Qi+\alpha r$" where "r" denotes a predetermined positive reward and "$\alpha$" denotes a predetermined learning rate between 0 and 1. The evaluation-value calculating block 27 obtains the latest evaluation values Qi of the other impression words from the evaluation-value storing block 39. The evaluation-value calculating block 27 updates the evaluation values Qi of the other impression words according to the above-indicated equation while replacing the predetermined positive reward by a predetermined negative reward. When an updated evaluation value is negative, it is reset to 0. For example, when the currently-selected impression word is "powerful", the predetermined positive reward is adopted and the updated evaluation value of the impression word "powerful" is calculated. For the other impression words, the predetermined negative reward is adopted and the updated evaluation values thereof are calculated. The evaluation-value calculating block 27 loads the evaluation-value storing block 39 with information representing the updated evaluation values of the currently-selected impression word and the other impression words.

FIG. 22 shows an example of the format of the information stored in the evaluation-value storing block 39. In FIG. 22, the evaluation value of the impression word "heavy" is equal to 10, and the evaluation value of the impression word "powerful" is equal to 10. The evaluation value of the impression word "slightly powerful" is equal to 27.1.

The second evaluation-value calculating process is as follows. The evaluation-value calculating block 27 refers to the impression-history storing block 40 to detect whether or not the currently-selected impression axis is in the stay state.

When the currently-selected impression axis is not in the stay state, the second evaluation-value calculating process terminates. On the other hand, when the currently-selected impression axis is in the stay state, the evaluation-value calculating block 27 calculates the evaluation value of the relation between the currently-selected impression axis and the immediately-previously-selected impression axis in the stay state. Specifically, the evaluation-value calculating block 27 obtains a pair of the currently-selected impression axis and the immediately-previously-selected impression axis in the stay state from the impression-history storing block 40. When the immediately-previously-selected impression axis in the stay state is absent, the evaluation-value calculating block 27 loads the impression-history storing block 40 with information representing the currently-selected impression axis as an immediately-previously-selected impression axis in the stay state. When the immediately-previously-selected impression axis in the stay state is present, the evaluation-value calculating block 27 obtains the latest evaluation value Ri of the relation between the currently-selected impression axis and the immediately-previously-selected impression axis in the stay state from the evaluation-value storing block 39. The evaluation-value calculating block 27 updates the evaluation value Ri according to an equation as "$Ri=(1-\alpha)Ri+\alpha r$" where "r" denotes a predetermined positive reward and "$\alpha$" denotes a predetermined learning rate between 0 and 1. The evaluation-value calculating block 27 obtains the latest evaluation values Ri of the relations between the immediately-previously-selected impression axis in the stay state and the impression axes except the currently-selected impression axis from the evaluation-value storing block 39. The evaluation-value calculating block 27 updates the obtained evaluation values Ri according to the above-indicated equation while replacing the predetermined positive reward by a predetermined negative reward. When an updated evaluation value is negative, it is reset to 0. The evaluation-value calculating block 27 loads the evaluation-value storing block 39 with information representing the updated evaluation value of the relation between the currently-selected impression axis and the immediately-previously-selected impression axis in the stay state and the updated evaluation values of the relations between the immediately-previously-selected impression axis in the stay state and the impression axes except the currently-selected impression axis.

Figures 23, 24:
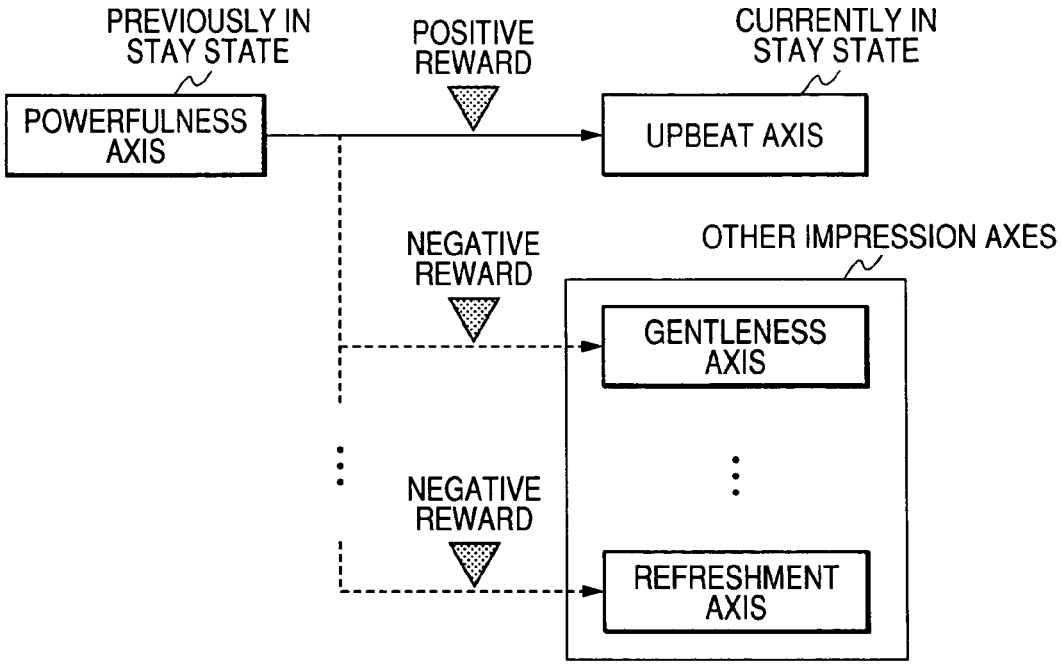
FIG. 23 is a diagram of an example of time-domain changes in a currently-selected impression axis.
FIG. 24 is a diagram showing an example of the format of second information in the evaluation-value storing block in FIG. 20.

With reference to FIG. 23, the impression axis "powerfulness" in the stay state is followed by the impression axis "upbeat" in the stay state. Therefore, the predetermined positive reward is adopted for the relation between the impression axis "powerfulness" and the impression axis "upbeat", and the updated evaluation value of the relation is calculated. On the other hand, the predetermined negative reward is adopted for the relations between the impression axis "powerfulness" and the impression axes except the impression axis "upbeat", and the updated evaluation values of the relations are calculated.

FIG. 24 shows an example of the format of the information stored in the evaluation-value storing block 39. As shown in FIG. 24, the information represents a table listing pairs of impression axes and evaluation values of the respective pairs. Information pieces representing the framework of the table and the pairs are stored in the evaluation-value storing block 39 in advance. Each pair has two impression axes corresponding to the currently-selected impression axis in the stay state and the immediately-previously-selected impression axis in the stay state respectively. In FIG. 24, the evaluation value of the relation between (the pair of) the currently-selected impression axis "upbeat" and the immediately-previously-selected impression axis "powerfulness" is equal to 40. The evaluation value of the relation between (the pair of) the currently-selected impression axis "gentleness" and the immediately-previously-selected impression axis "powerfulness" is equal to 10. The evaluation value of the relation between (the pair of) the currently-selected impression axis "powerfulness" and the immediately-previously-selected impression axis "upbeat" is equal to 30.

The second evaluation-value calculating process makes it possible to guess which of the music pieces the user desires to listen to next in terms of music-piece atmospheres after the user has listened to all of music pieces corresponding to the currently-selected impression axis.

When the first or second evaluation-value calculating process is completed, the control section 20B evaluates the now-playing music piece in accordance with the chosen command. During the evaluation, the control section 20B decides whether or not the chosen command is for changing the currently-selected impression axis. When the chosen command is for changing the currently-selected impression axis, the control section 20B performs either a first impression-axis changing process or a second impression-axis changing process. The first impression-axis changing process follows the first evaluation-value calculating process. The second impression-axis changing process follows the second evaluation-value calculating process.

The first impression-axis changing process is as follows. The control section 20B detects the currently-selected impression axis from the temporarily storing block 36. The control section 20B detects all the impression words different from the elements of the currently-selected impression axis from the impression-setting storing block 32. The control section 20B refers to the evaluation-value storing block 39 to obtain the evaluation values of the detected impression words. The control section 20B selects the maximum one among the obtained evaluation values. The control section 20B identifies the impression word having the selected maximum evaluation value. The control section 20B refers to the evaluation-value storing block 39 to identify the impression axis having elements inclusive of the identified impression word having the maximum evaluation value. Thus, the control section 20B selects the impression word having the maximum evaluation value, and the impression axis having the selected impression word as an element thereof. Alternatively, roulette selection may be implemented as follows. One is selected from the impression words different from the elements of the currently-selected impression axis on the basis of probabilities responsive to the impression-word evaluation values represented by the information in the evaluation-value storing block 39. The control section 20B calculates the probability Pi of selecting an impression word "i" from the evaluation value Qi of the impression word "i" according to an equation as:

$$P_i = \frac{Q_i}{\sum_{k=1}^{n} Q_k} \tag{1}$$

where Qk denotes the evaluation value of each impression word "k", and "n" denotes the total number of the impression words in the impression axes other than the currently-selected impression axis. The control section 20B selects one from the calculated probabilities Pi ($P_1$, $P_2$, . . . , $P_n$). The control section 20B selects an impression word corresponding to the selected probability. The control section 20B selects an impression axis having the selected impression word as an element thereof. The control section 20B loads the impression-history storing block 40 with information representing the selected impression axis and the selected impression word and information (time information) representing the present time, that is, the time of the change of the currently-selected impression axis and the currently-selected impression word. Information representing the impression axes which have been selected is stored in the temporarily storing block 36 so that these impression axes will not be selected again.

With reference to FIG. 25, the evaluation value of the impression word "heavy" is equal to 10, and the evaluation value of the impression word "powerful" is equal to 20. The evaluation value of the impression word "slightly powerful" is equal to 30. According to the maximum-responsive selection, the control section 20B selects the impression word "slightly powerful" since the evaluation value thereof is the maximum. Thus, the currently-selected impression word is changed to "slightly powerful". In FIG. 25, the probability concerning the impression word "heavy" is equal to 0.1667, and the probability concerning the impression word "powerful" is equal to 0.3333. The probability concerning the impression word "slightly powerful" is equal to 0.5. According to the roulette selection, the control section 20B generates a random value in the range of 0 to 1. Then, the control section 20B selects an impression word in accordance with the generated random value. Specifically, when the generated random value is less than 0.1667, the control section 20B selects the impression word "heavy" so that the currently-selected impression word will be changed to "heavy". When the generated random value is equal to or greater than 0.1667 but less than 0.5, the control section 20B selects the impression word "powerful" so that the currently-selected impression word will be changed to "powerful". When the generated random value is equal to or greater than 0.5, the control section 20B selects the impression word "slightly powerful" so that the currently-selected impression word will be changed to "slightly powerful".

The second impression-axis changing process is as follows. The control section 20B detects the currently-selected impression axis from the temporarily storing block 36. Then, the control section 20B implements maximum-responsive selection or roulette selection. According to the maximum-responsive selection, the control section 20B refers to the evaluation-value storing block 39 to obtain the evaluation values of the relations between the currently-selected impression axis and the other impression axes. The control section 20B selects the maximum one among the obtained evaluation values. The control section 20B identifies, among the other impression axes, one corresponding to the selected maximum evaluation value. The control section 20B labels the identified impression axis as a selected impression axis to which the currently-selected impression axis should be changed. According to the roulette selection, the control section 20B calculates the probabilities concerning change-destination candidate impression axes according to a prescribed equation being similar to the previously-indicated equation (1) and using "n" indicative of the total number of the change-destination candidate impression axes and "i" indicative of the relation between the currently-selected impression axis in the stay state and another impression axis. The control section 20B selects one from the change-destination candidate impression axes in accordance with the calculated probabilities. The control section 20B loads the impression-history storing block 40 with information representing the selected impression axis and information (time information) representing the present time, that is, the time of the change of the currently-selected impression axis.

With reference to FIG. 26, the impression axis "powerfulness" is in the stay state, and the evaluation value of the relation between the impression axis "powerfulness" and the change-destination candidate impression axis "gentleness" is equal to 20. The evaluation value of the relation between the impression axis "powerfulness" and the change-destination candidate impression axis "upbeat" is equal to 40. According to the maximum-responsive selection, the control section 20B selects the impression axis "upbeat" since the evaluation value corresponding thereto is the maximum. Thus, the currently-changed impression axis is changed to "upbeat". In FIG. 26, the probability concerning the relation between the impression axis "powerfulness" and the change-destination candidate impression axis "gentleness" is equal to 0.3333, and the probability concerning the relation between the impression axis "powerfulness" and the change-destination candidate impression axis "upbeat" is equal to 0.6667. According to the roulette selection, the control section 20B generates a random value in the range of 0 to 1. Then, the control section 20B selects an impression axis in accordance with the generated random value. Specifically, when the generated random value is smaller than 0.3333, the control section 20B selects the impression axis "gentleness" so that the currently-selected impression axis will be changed to "gentleness". When the generated random value is equal to or greater than 0.3333, the control section 20B selects the impression axis "upbeat" so that the currently-selected impression axis will be changed to "upbeat".

In the case where the currently-selected impression axis is changed without falling into the stay state, the control section 20B loads the temporarily storing block 36 with information representing that the currently-selected impression axis has already been selected. The impression-axis selection is implemented by the control section 20B while impression axes except already-selected ones are used as selection-destination candidate impression axes. When all the impression axes have already been used, the control section 20B clears the related information in the temporarily storing block 36.

With reference to FIG. 26, the impression axis "powerfulness" in the stay state is replaced by the impression axis "upbeat" which is a currently-selected impression axis. If the currently-selected impression axis ("upbeat") is changed without falling into the stay state, the impression axis "gentleness" having the second greatest probability will be selected according to the maximum-responsive selection. Since there is only one selection-destination candidate impression axis remaining which is the impression axis "gentleness", the impression axis "gentleness" will be selected according to the roulette selection.

In the second impression-axis changing process, the setting of impression words in an impression axis may be implemented in response to the evaluation values of the impression words in the previously-mentioned way. The initial evaluation value Qi is between 0 and the positive reward "r".

The evaluation values may vary from time range to time range in response to the time information. With reference to FIG. 27, a day is divided into time ranges of morning, noon, and night. The evaluation value of each impression word varies from time range to time range.

Figure 28:
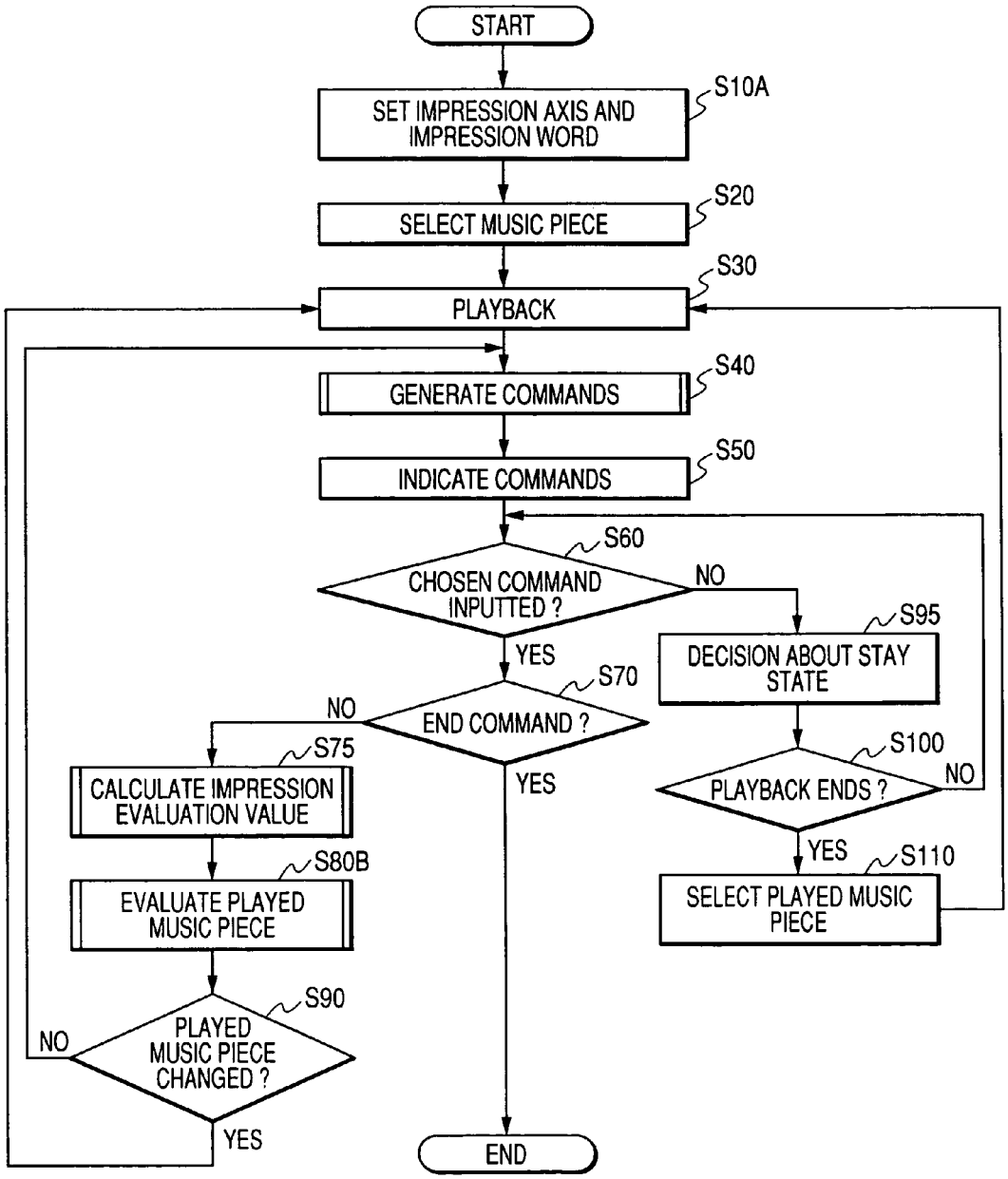
FIG. 28 is a flowchart of a control program for the apparatus in FIG. 20.

FIG. 28 is a flowchart of a control program for the music-piece retrieval and playback apparatus 1B. The control program in FIG. 28 includes a step S10A replacing the step S10 of FIG. 13. The step S10A sets an initial impression axis and an initial impression word. The step S10A labels the initial impression axis and the initial impression word as a currently-selected impression axis and a currently-selected impression word respectively. The step S10A generates impression-history information representing the present time, the currently-selected impression axis, and the currently-selected impression word. The step S10A stores the generated impression-history information in the storage unit 6. The stored impression-history information contains time information representing the present time which is an indication of the time of the change of the currently-selected impression axis and the currently-selected impression word.

The step S60 decides whether or not a command choice signal has been inputted by the user through the input device 10. When a command choice signal has been inputted, the program advances from the step S60 to the step S70. Otherwise, the program advances from the step S60 to a step S95.

The step S95 decides whether or not the currently-selected impression axis is in the stay state on the basis of the time information in the impression-history information in the storage unit 6. Furthermore, the step S95 decides whether or not the currently-selected impression word is in the stay state on the basis of the time information. When the currently-selected impression axis is in the stay state, the step S95 updates the impression-history information in the storage unit 6 to additionally represent that the currently-selected impression axis is in the stay state. When the currently-selected impression word is in the stay state, the step S95 updates the impression-history information in the storage unit 6 to additionally represent that the currently-selected impression word is in the stay state. After the step S95, the program advances to the step S100.

The step S70 decides whether or not the chosen command represented by the inputted command choice signal is the end command. When the chosen command is the end command, the program exits from the step S70 and then the current execution cycle of the program ends. Otherwise, the program advances from the step S70 to a block S75 for calculating evaluation values.

The block S75 performs either the first evaluation-value calculating process or the second evaluation-value calculating process. These processes are previously mentioned.

Figure 29:
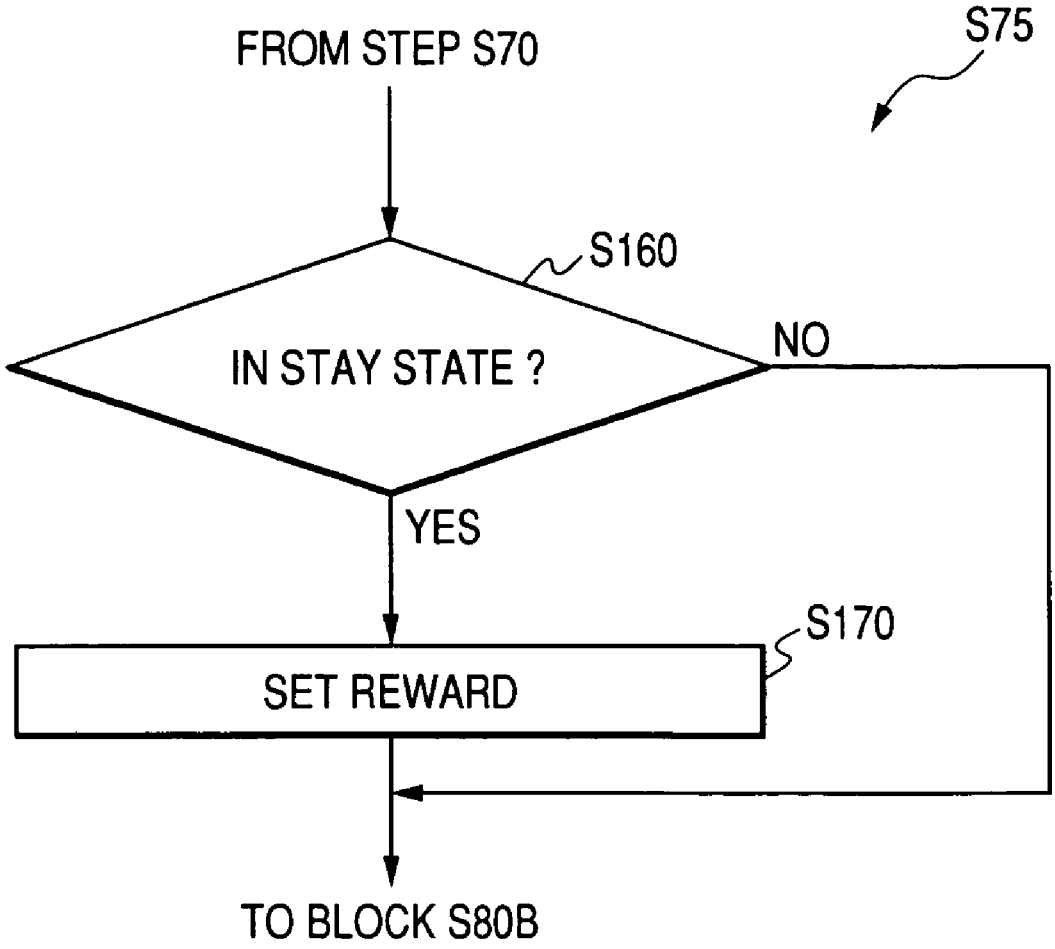
FIG. 29 is a flowchart of a block in FIG. 28.

As shown in FIG. 29, the block S75 includes steps S160 and S170. The step S160 follows the step S70.

During the first evaluation-value calculating process, the step S160 decides whether or not the currently-selected impression word is in the stay state on the basis of the impression-history information in the storage unit 6. When the currently-selected impression word is in the stay state, the program advances from the step S160 to the step S170. Otherwise, the program advances from the step S160 to a block S80B. The step S170 calculates the evaluation values of the currently-selected impression word and the other impression words in the previously-mentioned way. After the step S170, the program advances to the block S80B.

During the second evaluation-value calculating process, the step S160 decides whether or not the currently-selected impression axis is in the stay state on the basis of the impression-history information in the storage unit 6. When the currently-selected impression axis is in the stay state, the program advances from the step S160 to the step S170. Otherwise, the program advances from the step S160 to the block S80B. The step S170 calculates the evaluation value of the relation between the currently-selected impression axis and the immediately-previously-selected impression axis in the stay state in the previously-mentioned way. The step S170 calculates the evaluation values of the relations between the immediately-previously-selected impression axis in the stay state and the impression axes except the currently-selected impression axis in the previously-mentioned way. After the step S170, the program advances to the block S80B.

The block S80B is basically similar to the block S80 in FIG. 15, and has a step S130. The step S130 in the block S80 performs either the first impression-axis changing process or the second impression-axis changing process. These processes are previously mentioned. The step S130 decides whether the block S75 performs the first evaluation-value calculating process or the second evaluation-value calculating process. When the block S75 performs the first evaluation-value calculating process, the block S80B implements the first impression-axis changing process. When the block S75 performs the second evaluation-value calculating process, the block S80B implements the second impression-axis changing process.

When the currently-selected impression word is changed, the block S80B updates the impression-history information in the storage unit 6 to additionally represent the time of this change of the currently-selected impression word and a newly-selected impression word. The time information in the updated impression-history information represents the time of this change. When the currently-selected impression axis is changed, the block S80B updates the impression-history information in the storage unit 6 to additionally represent the time of this change of the currently-selected impression axis and a newly-selected impression axis. The time information in the updated impression-history information represents the time of this change. After the block S80B, the program advances to the step S90.

As previously mentioned, the evaluation values of the impression words are calculated. The evaluation values concerning the impression axes are calculated. The utilization of the calculated evaluation values enables the user to quickly find an impression word suiting to user's taste. As previously mentioned, the relations among impression axes are evaluated. This evaluation enables the user to select music pieces in harmony with user's taste such that music pieces having atmospheres "A" are desired to be listened to after music pieces having atmospheres "B" have been listened to.

FOURTH EMBODIMENT

Figure 30:
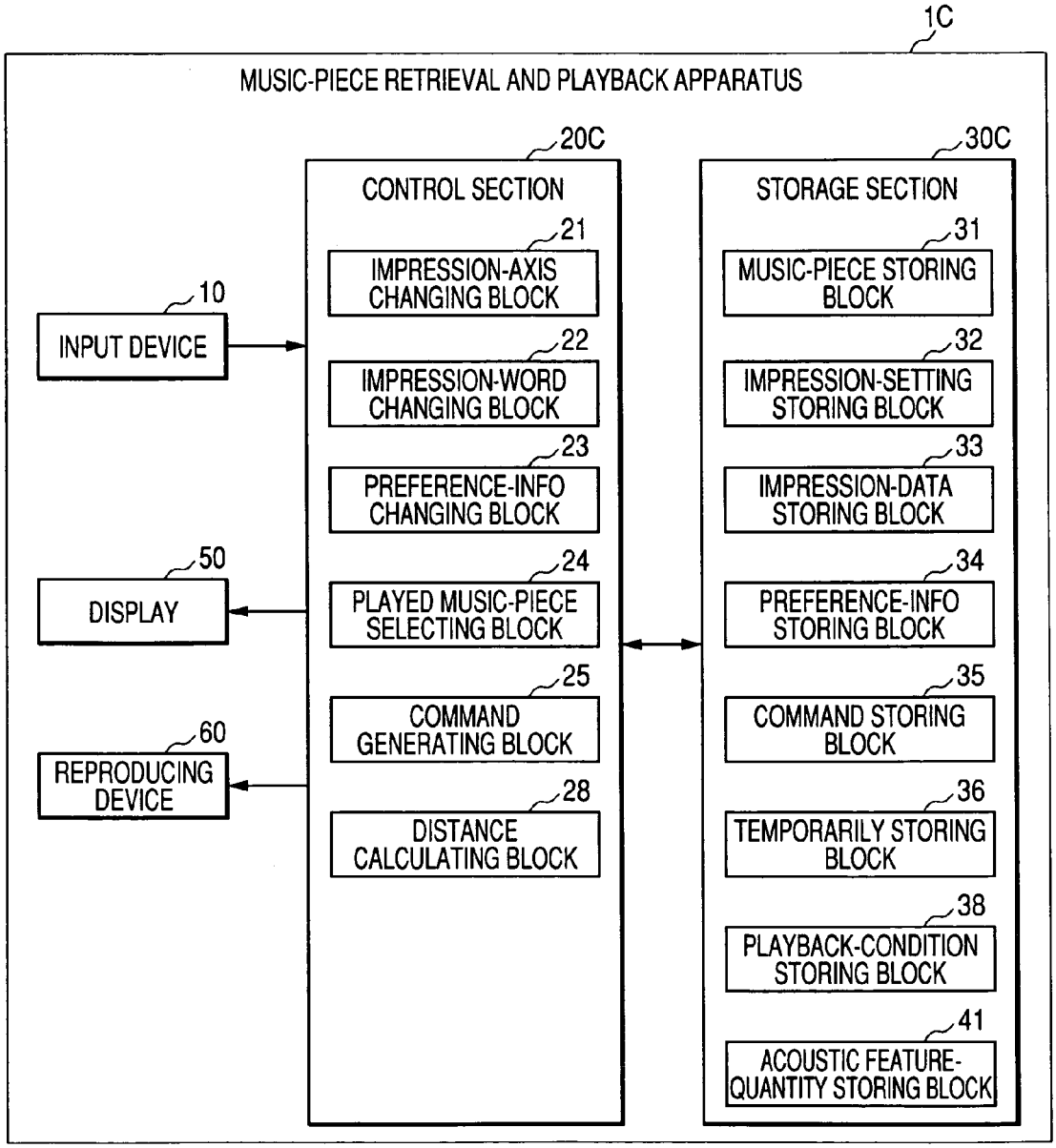
FIG. 30 is an operation diagram of a music-piece retrieval and playback apparatus according to a fourth embodiment of this invention.

FIG. 30 basically shows the operation of a music-piece retrieval and playback apparatus 1C according to a fourth embodiment of this invention. The music-piece retrieval and playback apparatus 1C is similar to the music-piece retrieval and playback apparatus 1 (see FIGS. 1 and 2) except for design changes mentioned hereafter.

As shown in FIG. 30, a major portion of the music-piece retrieval and playback apparatus 1C is divided into a control section 20C and a storage section 30C which replace the control section 20 and the storage section 30 (see FIG. 2). The control section 20C implements a distance calculating block 28. The storage section 30C implements a playback-condition storing block 38 and an acoustic-feature-quantity storing block 41. The playback-condition storing block 38 is similar to that in FIG. 16.

The distance calculating block 28 calculates the Euclidean distance between two designated music pieces from acoustic feature quantities thereof which are represented by information stored in the acoustic-feature-quantity storing block 41.

The acoustic-feature-quantity storing block 41 stores information indicating the feature quantities of the digital audio signals representing the music pieces. The feature quantities are obtained as follows. Each digital audio signal is analyzed and then acoustic feature quantities of the digital audio signal are computed from the results of the analyzation in a conventional way, for example, a way disclosed by Japanese patent application publication number 6-290574/1994 or Japanese patent application publication number 2002-278547.

FIG. 31 shows an example of the format of the information in the acoustic-feature-quantity storing block 41. For each of the digital audio signals, the computed acoustic feature quantities are numbered from "1" to "N", where "N" denotes a predetermined natural number. As shown in FIG. 31, the information in the acoustic-feature-quantity storing block 41 indicates a set of acoustic feature quantities "1" to "N" in correspondence with the content ID of a music piece represented by each digital audio signal.

The music-piece retrieval and playback apparatus 1C operates as follows. The command generating block 25 generates commands including a command for playing back a prescribed number of music pieces similar in atmospheres to the now-playing music piece. The command generating block 25 assigns ID numbers to the generated command respectively. An example of the command for playing back a prescribed number of music pieces similar in atmospheres to the now-playing music piece has a message of "desire music pieces similar to this one".

The control section 20C decides whether or not the inputted command (the chosen command) is for playing back a prescribed number of music pieces similar in atmosphere to the now-playing music piece.

In the case where the inputted command is not for playing back a prescribed number of music pieces similar in atmosphere to the now-playing music piece, the control section 20C decides whether or not the chosen command is for changing the currently-selected impression axis through the execution of the step S120 in FIG. 15.

On the other hand, in the case where the inputted command is for playing back a prescribed number of music pieces similar in atmosphere to the now-playing music piece, the control section 20C reads out the content ID of the now-playing music piece from the temporarily storing block 36. The control section 20C reads out, from the acoustic-feature-quantity storing block 41, N feature quantities corresponding to the content ID of the now-playing music piece. The control section 20C stores information representative of the read-out N feature quantities into the temporarily storing block 36.

Subsequently, the distance calculating block 28 reads out, from the acoustic-feature-quantity storing block 41, N feature quantities corresponding to the content IDs of the music pieces other than the now-playing music piece. The distance calculating block 28 reads out, from the temporarily storing block 36, the N feature quantities corresponding to the content ID of the now-playing music piece. The distance calculating block 28 calculates the Euclidean distance between the now-playing music piece and each of the other music pieces from the feature quantities of thereof according to the following equation.

$$d(j) = \sqrt{\sum_{i=1}^{N} (x_i - y_{ij})^2} \tag{2}$$

where "$x_i$" denotes the i-th feature quantity among the feature quantities corresponding to the now-playing music piece, and "$y_{ij}$" denotes the i-th feature quantity among the feature quantities of a music piece "j" different from the now-playing music piece. When the now-playing music piece is identified by the value "f" and the number of the music pieces related to the information stored in the acoustic-feature-quantity storing block 41 is denoted by G, the variable "j" is in the range of 1 to G and differs from the value "f". The distance calculating block 28 loads the temporarily storing block 36 with information representing the calculated Euclidean distances d(j) and the content IDs corresponding thereto.

The control section 20C selects, from the Euclidean distances in the temporarily storing block 36, a prescribed number of smaller Euclidean distances being the first, second, and later smallest ones. The control section 20C may select, from the Euclidean distances in the temporarily storing block 36, those smaller than a prescribed value.

Alternatively, the control section 20C may select, from the Euclidean distances in the temporarily storing block 36, a prescribed number of greater Euclidean distances being the first, second, and later greatest ones. The control section 20C may select, from the Euclidean distances in the temporarily storing block 36, those greater than a prescribed value.

The above-mentioned selection of the smaller Euclidean distances causes selection of music pieces similar in atmospheres to the now-playing music piece. Immediately after the selection of such music pieces, the now-playing music piece may be changed. In this case, the control section 20C chooses a music piece, which corresponds to the smallest one or the greatest one among the calculated Euclidean distances, as new one for the now-playing music piece (as one becoming a new now-playing music piece). At that time, the control section 20C refers to the impression-data storing block 33, and thereby obtains the impression axis and the impression word corresponding to the chosen music piece. The control section 20C stores the obtained impression axis and the obtained impression word into the temporarily storing block 36 as the currently-selected impression axis and the currently-selected impression word.

The control section 20C reads out the content IDs corresponding to the selected Euclidean distances from the temporarily storing block 36. The control section 20C stores the read-out content IDs into the playback-condition storing block 38.

The control section 20C reads out the content IDs from the playback-condition storing block 38. The control section 20C reads out, from the music-piece storing block 31, digital audio signals representative of respective music pieces having content IDs equal to the read-out content IDs. The control section 20C feeds the read-out digital audio signals to the reproducing device 60. The control section 20C controls the reproducing device 60 to play back the music pieces represented by the digital audio signals. After reading out the content IDs from the playback-condition storing block 38, the control section 20C deletes them therefrom. When no content ID remains in the playback-condition storing block 38, the control section 20C conducts an action similar to that of the step S110 in the first embodiment of this invention.

It is possible to meet user's need to listen to music pieces similar in atmospheres to the now-playing music piece or music pieces totally different in atmospheres from the now-playing music piece.

Figure 32:
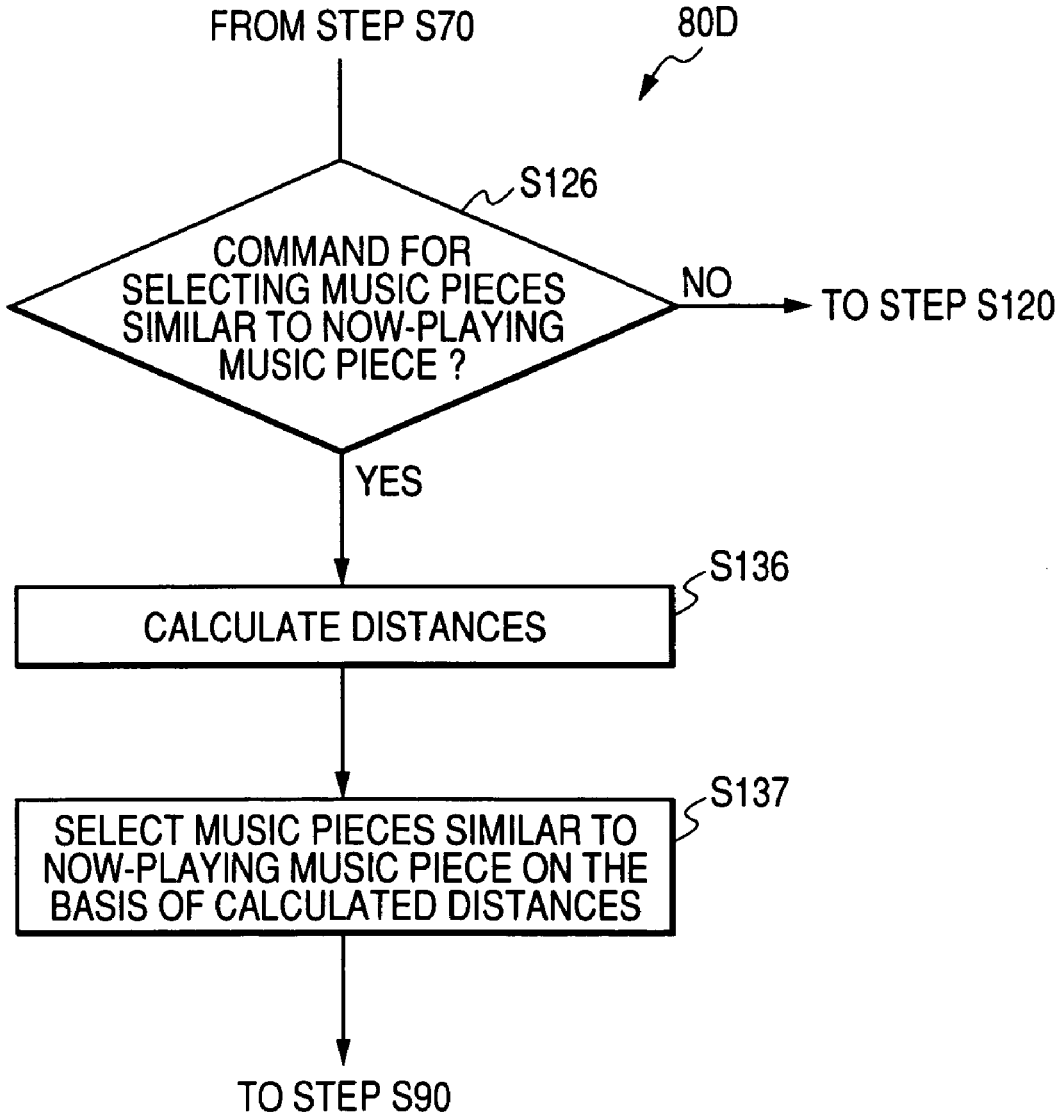
FIG. 32 is a flowchart of a block in a control program for a music-piece retrieval and playback apparatus according to a fourth embodiment of this invention.

FIG. 32 shows a block S80D in a control program for the music-piece retrieval and playback apparatus 1C. The block S80D replaces the block S80 in FIG. 15.

As shown in FIG. 32, the block S80D includes a step S126 following the step S70 (see FIG. 13). The step S126 decides whether or not the inputted command (the chosen command) is for playing back a prescribed number of music pieces similar in atmosphere to the now-playing music piece. When the inputted command is for playing back a prescribed number of music pieces similar in atmosphere to the now-playing music piece, the program advances from the step S126 to a step S136. Otherwise, the program advances from the step S126 to the step S120 (see FIG. 15).

The step S136 reads out, from the storage unit 6, N feature quantities corresponding to the content ID of the now-playing music piece. The step S136 reads out, from the storage unit 6, N feature quantities corresponding to the content IDs of the music pieces other than the now-playing music piece. The step S136 calculates the Euclidean distance between the now-playing music piece and each of the other music pieces from the feature quantities thereof according to the previously-indicated equation (2). The step S136 detects the correspondence between the calculated Euclidean distances and the content IDs.

A step S137 following the step S136 selects, from the calculated Euclidean distances, a prescribed number of smaller Euclidean distances being the first, second, and later smallest ones. The step S137 may select, from the calculated Euclidean distances, those smaller than a prescribed value.

Alternatively, the step S137 may select, from the calculated Euclidean distances, a prescribed number of greater Euclidean distances being the first, second, and later greatest ones. The step S137 may select, from the calculated Euclidean distances, those greater than a prescribed value.

The step S137 detects the content IDs corresponding to the selected Euclidean distances. The step S137 loads the RAM 5 with information (playback-condition information) representing that music pieces having content IDs equal to the detected ones should be played back. The playback-condition information contains the content IDs of the music pieces described therein. The playback-condition information will be used by the step S110 (see FIG. 13) later. After the step S137, the program advances to the step S90 (see FIG. 13).

The step S137 may be followed by a step of deciding whether or not the now-playing music piece should be changed. When it is decided that a played music piece should be changed, a first later step chooses a music piece, which corresponds to the smallest one or the greatest one among the calculated Euclidean distances, as new one for the now-playing music piece (as one becoming a new now-playing music piece). Then, a second later step refers to the impression data, and thereby obtains the impression axis and the impression word corresponding to the chosen music piece. A third later step labels the obtained impression axis and the obtained impression word as the currently-selected impression axis and the currently-selected impression word.

The step S110 (see FIG. 13) reads out the playback-condition information from the RAM 5, and selects one from the music pieces described in the read-out playback-condition information as an object to be played back. The selected music piece will be played back by the reproducing device 60. The step S110 detects the content ID of the selected music piece. The step S110 deletes the content ID of the selected music piece from the playback-condition information, and thereby updates the playback-condition information. The step S110 writes the updated playback-condition information over the old playback-condition information in the RAM 5.

The music-piece retrieval and playback apparatus 1C may use only feature quantities as parameters for music-piece retrieval without using the impression axes and the impression words.

What is claimed is:

1. A music-piece retrieval and playback apparatus comprising:

a first storage device storing music pieces having identifiers respectively;

a second storage device storing impression words expressing impressions about music pieces, the stored impression words being separated into groups called impression axes, wherein impression words in each of the impression axes have meanings mutually related with each other and are assigned prescribed ranks;

a third storage device storing the impression words and the identifiers of the music pieces in a manner such that an impression word among the stored impression words is made to correspond to each of the music pieces, and is related with an identifier of each corresponding music piece;

first control means for designating an impression axis and an impression word;

second control means for obtaining an identifier corresponding to the impression axis and the impression word designated by the first control means from the third storage device;

third control means for reading out a music piece having an identifier equal to the identifier obtained by the second control means from the first storage device;

fourth control means for generating commands which are designed for changing the impression word designated by the first control means in response to the impression axis and the impression word designated by the first control means;

input means for enabling a user to choose one of the commands generated by the fourth control means;

fifth control means for obtaining an impression axis and an impression word corresponding to the command chosen by the user from the second storage device; and sixth control means for updating the impression axis and the impression word designated by the first control means to the impression axis and the impression word obtained by the fifth control means.

2. A music-piece retrieval and playback apparatus as recited in claim 1, wherein the commands generated by the fourth control means comprise a command for replacing the designated impression word with an impression word having a rank higher or lower by 1 than the rank of the designated impression word in the designated impression axis.

3. A music-piece retrieval and playback apparatus as recited in claim 1, wherein the commands generated by the fourth control means comprise a command for replacing the designated impression axis with another impression axis.

4. A music-piece retrieval and playback apparatus comprising:

a first storage device storing music pieces having identifiers respectively;

first control means for reading out a music piece from the first storage device;

a second storage device storing bibliographic information segments about the respective music pieces stored in the first storage device and the identifiers of the music pieces, and relating the stored bibliographic information pieces with the identifiers of the music pieces respectively;

first reproducing means for playing back the music piece read out by the first control means;

second control means for generating commands constituting questionnaire choice information concerning the bibliographic information segments;

input means for enabling the user to choose one of the commands generated by the second control means;

third control means for obtaining a bibliographic information segment related with the identifier of the music piece played back by the first reproducing means from the second storage device;

fourth control means for generating a playback condition from the bibliographic information segment obtained by the third control means and the command chosen by the user through the input means;

fifth control means for obtaining an identifier corresponding to the playback condition generated by the fourth control means from the second storage device;

sixth control means for reading out a music piece having an identifier equal to the identifier obtained by the fifth control means from the first storage device; and second reproducing means for playing back the music piece read out by the sixth control means.

5. A music-piece retrieval and playback apparatus comprising:

a first storage device storing music pieces having identifiers respectively;

a second storage device storing acoustic feature quantity information segments about the respective music pieces stored in the first storage device and the identifiers of the music pieces, and relating the stored acoustic feature quantity information segments with the identifiers of the music pieces respectively;

first control means for generating a command to play back a prescribed number of music pieces similar to a music piece currently played back;

input means for enabling a user to choose the command generated by the first control means;

second control means for reading out the feature quantity information segments from the second storage device when the command is chosen by the user through the input means;

third control means for calculating Euclidean distances between one of the feature quantity information segments read out by the second control means and others of the feature quantity information segments read out by the second control means, wherein the one of the feature quantity information segments corresponds to the identifier of the music piece currently played back;

fourth control means for selecting the prescribed number of smaller ones among the Euclidean distances calculated by the third control means;

fifth control means for detecting identifiers corresponding to the Euclidean distances selected by the fourth control means;

sixth control means for reading out the prescribed number of music pieces having identifiers equal to the identifiers detected by the fifth control means; and reproducing means for playing back the music pieces read out by the sixth control means.

6. A music-piece retrieval and playback apparatus as recited in claim 1, further comprising:

a fourth storage device storing degrees of user's preference for the respective music pieces stored in the first storage device and the identifiers of the music pieces, and relating the stored users preference degrees with the identifiers of the music pieces respectively; and seventh control means provided in the second control means for utilizing the fourth storage device and obtaining an identifier from among the identifiers except identifiers corresponding to user's preference degrees less than a prescribed value or obtaining an identifier corresponding to a greatest users preference degree.

7. A music-piece retrieval and playback apparatus as recited in claim 4, further comprising:

a third storage device storing degrees of users preference for the respective music pieces stored in the first storage device and the identifiers of the music pieces, and relating the stored user's preference degrees with the identifiers of the music pieces respectively; and seventh control means for utilizing the third storage device and obtaining an identifier from among the identifiers except identifiers corresponding to user's preference degrees less than a prescribed value or obtaining an identifier corresponding to a greatest user's preference degree.

8. A music-piece retrieval and playback apparatus as recited in claim 1, further comprising;

a fourth storage device storing evaluation values of the impression words;

seventh control means for increasing one of the evaluation values stored in the fourth storage device in cases where a music piece corresponding to the one of the evaluation values is repetitively played back at least a prescribed number of times or is continuously played back for at least a prescribed time; and eighth control means provided in the fifth control means for obtaining an impression word in response to the evaluation values stored in the fourth storage device.

9. A music-piece retrieval and playback apparatus as recited in claim 1, further comprising:

a fourth storage device storing sets each of a first impression axis and a second impression axis, and evaluation values of the sets;

a fifth storage device storing each impression axis and each time order in cases where a music piece corresponding to the impression axis is repetitively played back at least a prescribed number of times or is continuously played back for at least a prescribed time;

seventh control means for increasing an evaluation value stored in the fourth storage device while making two impression axes adjacent in time order in the fifth storage device correspond to the first impression axis and the second impression axis in the fourth storage device; and eighth control means provided in the fifth control means for obtaining an impression axis in response to the evaluation values stored in the fourth storage device.

10. A music-piece retrieval and playback apparatus comprising:

first control means for designating one among impression axes and one among impression words, wherein the impression words express impressions about music pieces and are separated into groups called the impression axes, wherein impression words in each of the impression axes have meanings mutually related with each other, and wherein there is a correspondence among the impression words, the impression axes, and the music pieces;

first reproducing means for playing back a music piece corresponding to the impression axis and the impression word designated by the first control means;

second control means for generating commands constituting questionnaire choice information about the music piece played back by the first reproducing means;

input means for enabling a user to choose one of the commands generated by the second control means;

third control means for obtaining an impression axis and an impression word corresponding to the command chosen by the user; and second reproducing means for playing back a music piece corresponding to the impression axis and the impression word obtained by the third control means.

11. A method of music-piece retrieval and playback, comprising the steps of:

designating one among impression axes and one among impression words, wherein the impression words express impressions about music pieces and are separated into groups called the impression axes, wherein impression words in each of the impression axes have meanings mutually related with each other, wherein the music pieces have identifiers respectively, and wherein there is a correspondence among the impression words, the impression axes, and the identifiers;

obtaining a first identifier corresponding to the designated impression axis and the designated impression word;

playing back a music piece having an identifier equal to the obtained first identifier;

generating commands constituting questionnaire choice information about the played back music piece;

enabling a user to choose one of the generated commands;

obtaining an impression axis and an impression word corresponding to the command chosen by the user;

obtaining a second identifier corresponding to the obtained impression axis and the obtained impression word; and playing back a music piece having an identifier equal to the obtained second identifier.

* * * * *